US009707695B2

(12) United States Patent
Grisley

(10) Patent No.: US 9,707,695 B2
(45) Date of Patent: Jul. 18, 2017

(54) JOINT MAKING JIG

(71) Applicant: Leigh Industries, Ltd., Port Coquitlam (CA)

(72) Inventor: Kenneth McLean Grisley, Coquitlam (CA)

(73) Assignee: Leigh Industries, Ltd. (CA)

( * ) Notice: Subject to any disclaimer, the term of this patent is extended or adjusted under 35 U.S.C. 154(b) by 937 days.

(21) Appl. No.: 14/028,419

(22) Filed: Sep. 16, 2013

(65) Prior Publication Data

US 2014/0014233 A1 Jan. 16, 2014

Related U.S. Application Data

(63) Continuation-in-part of application No. 12/958,919, filed on Dec. 2, 2010, now Pat. No. 8,534,329.

(51) Int. Cl.
*B27F 1/08* (2006.01)
*B27F 1/12* (2006.01)

(52) U.S. Cl.
CPC . *B27F 1/08* (2013.01); *B27F 1/12* (2013.01)

(58) Field of Classification Search
CPC ..... B27C 5/00; B27C 5/04; B27F 5/00; B27F 5/02; B27F 5/12; B27F 1/12; B27F 1/14; B27F 1/08
USPC ..... 144/144.1
See application file for complete search history.

(56) References Cited

U.S. PATENT DOCUMENTS 2,605,790 A 8/1952 Schwarzer
4,405,004 A * 9/1983 Dicke ..... B27F 1/12 144/144.51
5,114,265 A 5/1992 Grisley
5,285,832 A * 2/1994 Gibson ..... B27F 1/12 144/144.51
5,423,357 A * 6/1995 Szymanski ..... B27F 1/12 144/144.51
5,711,356 A 1/1998 Grisley
5,890,524 A 4/1999 Tucker et al.
5,983,968 A 11/1999 Newman
6,076,575 A * 6/2000 Harkness ..... B27F 1/12 144/144.1
6,530,302 B1 3/2003 Rogers
7,703,488 B1 4/2010 Douglas
8,256,475 B2 9/2012 Grisley
8,534,329 B2 9/2013 Grisley
9,375,860 B2 6/2016 Grisley
2003/0196726 A1 10/2003 Tucker et al.
2006/0249228 A1 * 11/2006 Hout ..... B27F 1/12 144/144.1
2009/0272463 A1 * 11/2009 Smith ..... B23B 47/28 144/144.52

OTHER PUBLICATIONS

Prazi USA, www.prazi.usa.com, The Unique and Versative Joinery System, believed to be available as early as Jul. 2012, 1 page.

* cited by examiner

*Primary Examiner* — Matthew G Katcoff

(74) *Attorney, Agent, or Firm* — Kilpatrick Townsend & Stockton LLP

(57) ABSTRACT

A woodworking joint cutting jig and method having a template repositionably attachable to a base in a plurality of alternative positions established by receiving a pin on one of the base or template in one of a plurality of holes on the other of the template and the base.

17 Claims, 30 Drawing Sheets

JOINT MAKING JIG

CROSS REFERENCE TO RELATED APPLICATION

This application is a continuation-in-part of U.S. patent application Ser. No. 12/958,919, filed Dec. 2, 2010 (Publication No. US 2012/01381193), which is incorporated herein by reference in its entirety.

FIELD OF THE INVENTION

This invention relates to methods and apparatus for guiding a workpiece or woodworking power tool used to cut joint members in wood workpieces. In particular, the device of the present invention is a template intended for making dovetail, box and similar joints.

BACKGROUND

Wooden boxes, drawers and storage chests and a variety of other wooden furniture and other objects often use dovetail joints as a means of securely assembling components. A dovetail is a joint, usually right angled, formed of one or more projecting parts, i.e., tenons or pins, that fit tightly within corresponding recesses, i.e., mortises or gaps between tails, to form a joint. The pin is typically broader at its end than at its base. Dovetail joints are considered by most cabinet makers to be the strongest and most permanent joint typically made in cabinet making. A dovetail joint is generally employed in articles made of thinner materials such as drawers, boxes, chests, and the like.

Dovetails are used for both their decorative appearance and their high strength. Such joints can be made without industrial machinery in one of two principal ways, either using hand tools: saws and chisels, or using power tools such as a router. In both cases, making such a joint requires a high degree of skill and precision. Furthermore, making such a joint using hand tools is time consuming. The desire to save time motivates some woodworkers to use power tools, and the need for precision, often in the relative absence of skill, makes jigs or machines that control the power tools desirable.

The use of a power tool such as a router allows two different approaches. The router can be held stationary and the workpiece moved relative to the position of the router cutter, or the workpiece can be held stationary and the router moved relative to the workpiece. Additionally, in a variation of both basic approaches, both the router and the workpiece may move.

The modern electric router has made this process much easier with the help of router cutters, holding fixtures and templates. With fixtures, the workpiece is clamped into the fixtures and machined after the template location is set.

Most dovetail and other joint-making jigs utilize an array of "fingers" to guide a router cutter during engagement of the workpiece or workpieces to remove waste material and leave "pins" on one work piece and "tails" on the other work piece. The arrays of fingers are typically provided in one of two ways. In the first alternative template structure, a molded or machined plastic or metal template has multiple fingers, each of which has a fixed position relative to other fingers on the template. In the second alternative, fingers are attached to and can be moved relative to each other on a finger-carrying plate or bar, which facilitates manufacture of joints with variably spaced pins and tails rather than ones that are spaced only the predetermined amounts required by a molded or machined template.

One of the challenges associated with use of joint-making jigs is adjustment of joint fit. Because of differences in wood species, cutter geometry and diameter and other reasons, it is desirable to be able to adjust the exact path of the router cutter. This is sometimes done by making possible adjustment of the finger-carrying template plate or bar (and, therefore, finger positions) in setting up the jig or in the course of use or both.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Embodiments of this invention are jigs that facilitate cutting dovetail and other wood joints such as box joints or rounded shaped joints.

These jigs use templates that supports and guides an electric router to cut joint members in the workpieces. A locating structure facilitates moving the template with respect to the workpiece a pre-determined distance between a first position to cut joint members on the work pieces, and a second position to cut additional joint members on the workpieces. The jig also has a side stop and a plurality of pin plates that accurately position the template with respect to the workpiece.

A template may be provided with multiple sets of guide fingers that guide the electric router. Each set of guide fingers is shaped and dimensioned to permit cutting of a particular size of joint member. In one embodiment, the template comprises more than one set of guide fingers.

Alternative arrangements of the template guide fingers are possible. For example, other embodiments of templates are disclosed in U.S. Pat. Nos. 5,711,356 and 5,114,265, where the templates are slideably attached to a bar, which patents are incorporated herein by reference. A pin positions the prior art template on the bar in two locations in the X axis to provide the correct offset for two mating boards. Additional holes in the template allow for other X axis positions used to make box joints that are half or a quarter the size of the array of fingers. The Y axis positioning for these templates and finger assemblies relative to the jigs' clamp face is provided by the sliding scales on the jig support brackets. In an embodiment on conventional bench mounted type jigs, a box joint template can have the X axis positioning holes at one end of the active front array of fingers and a matching low tolerance slot at the other end.

The present invention can be incorporated into various types of jig arrangements. The present invention uses fixed pins spaced apart on a beam, on jig brackets, or on the jig frame, either on conventional bench mounted type jigs, on purpose-made router table jigs or, in the case of the beam model, either 'upside-down' on a router table or 'right side up' using a hand held router.

On beam type jigs, the relatively short and lower cost template is "stepped over" with absolute precision from No's 1 & 2 pins to No's 2 & 3 pins, and so on. This concept lends itself to a 'kit' version because precise X and Y axis positioning of steel plates and index pins on a beam is achieved by use of integral set-up holes in the template, permitting the user to check and precisely adjust the pin plate positions through screwdriver access holes as necessary to correct for any beam expansion or contraction that may occur between uses. This jig may be used right side up for hand routing or upside down on a router table.

On such conventional bench mounted and beam type jigs, the fixed jig pins and additional template holes provide precise X axis template offsetting for mating box joints as well as half and quarter size joints.

Among other attachment alternatives, templates can be attached to the steel pin plates by powerful rare earth magnets set flush with, or just below the template surface, by mechanical means such as sliding clips on the router table jig, or by turnbuckle clips. The indexing pins restrain movement of the templates horizontally, creating a very secure set-up that is quick and easy to use.

The indexing pins also provide precise Y axis template positioning (relative to the jig front face) for routing through dovetail pins. The through dovetail pin mode has Y axis control holes that step the assemblies in or out relative to the clamp face to allow for routing different sized through dovetail pin guides to match the dovetail bit socket.

Moving the template with respect to fixed workpiece positioning members requires no adjustment of the positioning members or workpieces. This allows for more accurate and faster cutting of the joints. For workpieces wider than the template, the present invention allows the user to simply move the template over or move the beam and workpiece over.

This invention therefore provides a versatile joint making machine for use with a router to make woodworking joints. The machine of this invention is accurate, easy to use, and easy to set up for making a wide range and variety of different joints. Other advantages and benefits of this invention will be apparent from the drawings and the following description of the invention and claims. This invention provides a dovetailing jig assembly that includes a dovetailing jig removably attachable to a workpiece, a scab board that abuts the workpiece, and a backup board, supporting the scab board removably attached to the jig. The jig may include a side stop, a template, and a plurality of removable pin plates that variably position the template with respect to the workpiece.

A second set of embodiments of this invention are jigs that facilitate cutting dovetail and other wood joints such as box joints.

This jig uses one or more templates that support and guide an electric router to cut joint members in workpieces secured to a base or other structure to which the template is also attached. The templates may have integrally formed guide fingers. Templates may also be provided with guide fingers that are removable and repositionable on the template by slideable attachment to a plate, bar or other structure.

Locating pins mounted on one of each template or the base are received in pin holes or a slot in the other of the base or the templates. While the pin locations or pin hole locations may be adjustable, such adjustment typically may need to be done only once during "set-up." Selection of the holes to receive the locator pins will then be done by reference to the type of joint being cut and or general spacing.

Adjustment of the jig or its components for the purpose of achieving a desired joint "fit" is not necessary and may not even need to be possible. If desired, such adjustment may be achieved by use of an adjustable guidebush. Such a guidebush is disclosed in U.S. Pat. No. 8,256,475 and U.S. patent application Ser. No. 13/566,345 filed Aug. 3, 2012 (Patent Publication no US 2012/029192, published Nov. 22, 2012), which are incorporated herein in their entireties by this reference.

In one embodiment of the jig invention, fixed or adjustable position pins secured on the jig body are used to locate the side to side position of the template on the jig body by positioning the template by a selected one of multiple holes in the template.

A box joint template may have multiple "X axis" (extending along the width of the template transverse to the fingers) positioning holes on one end of the template for the active front comb and a matching close tolerance slot (extending along the X axis) at the other end of the template permitting the template to be moved along the X axis but preventing movement along the "Y axis" in the directions the fingers extend.

The fixed jig pins and additional template holes provide precise X axis template offsetting for mating box joints as well as half and quarter size joints.

In a second operating mode for cutting through dovetail joint components, the indexing pins provide precise Y axis template positioning (relative to the jig front face) for routing through dovetail pins. The through dovetail pin mode has Y axis control holes that step the assemblies in or out relative to the clamp face to allow for routing different sized through dovetail pin guides to match the dovetail bit socket.

Among other attachment alternatives, templates can be attached to the steel pin plates by powerful rare earth magnets set flush with, or just below the template surface, by mechanical means such as sliding clips on the router table jig, or by turnbuckle clips. The indexing pins restrain movement of the templates horizontally, creating a very secure set-up that is quick and easy to use.

This invention therefore provides a versatile joint-making machine for use with a router to make woodworking joints. This invention is accurate, easy to use, and easy to set up for making a wide range and variety of different joints. Other advantages and benefits of this invention will be apparent from the drawings and the following description of the invention and claims.

DETAILED DESCRIPTION OF THE DRAWINGS

Figure 1:
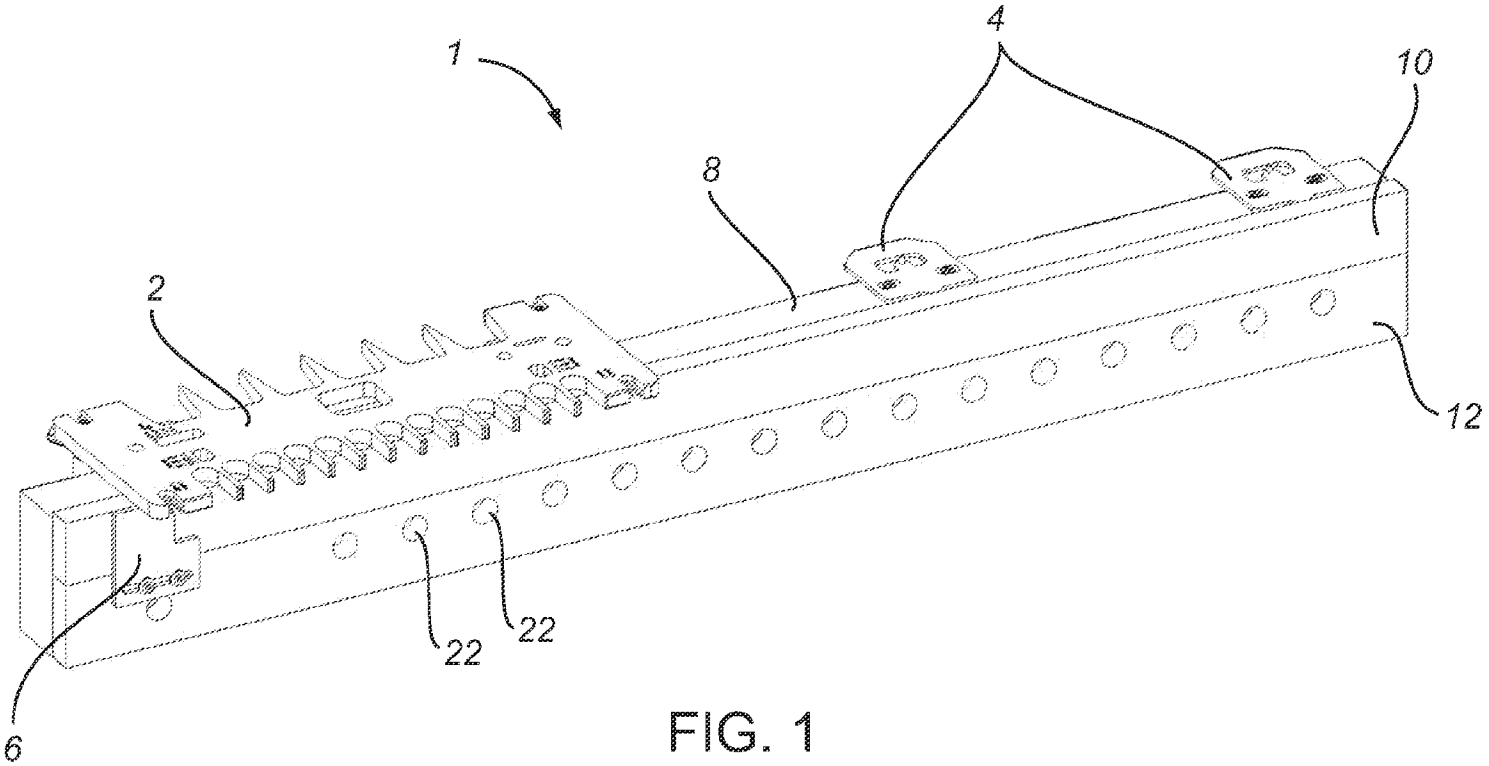
FIG. 1 is an isometric view of the tail face, top, and one end of a first embodiment of the woodcutting jig of this invention shown mounted on a positioning beam and scab board.
Figure 13:
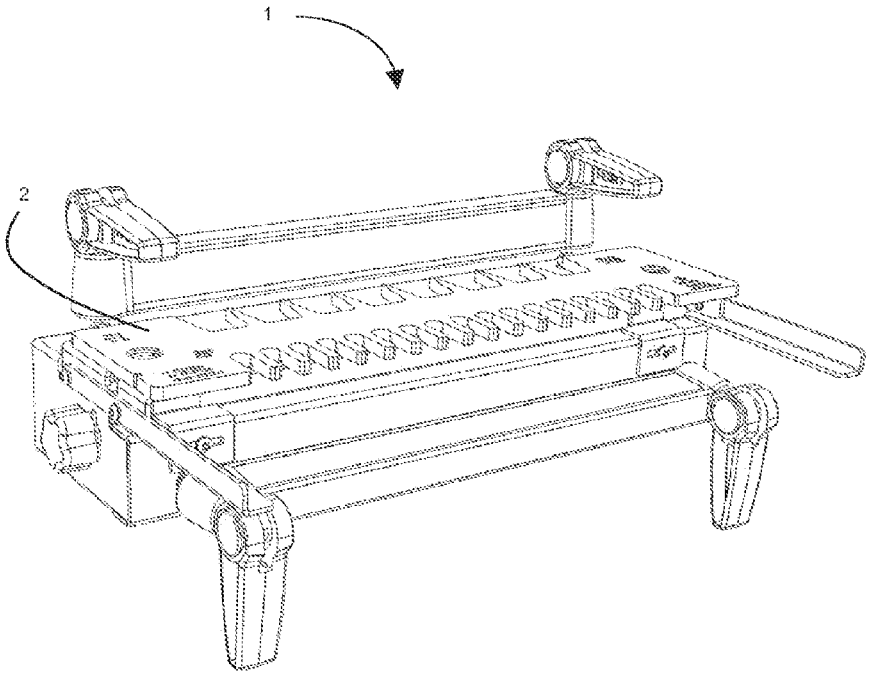
FIG. 13 is a view of another embodiment of the woodcutting shown in FIG. 1.

The woodcutting jig 1 of this invention, shown in FIG. 1, is used for securing workpieces and providing a path for an electric router to cut joint members in wood workpieces. A workpiece is temporarily secured by clamping the workpiece to a backup board and scab board. A cutter positioned in an electric router is then guided by the template 2 to cut pins and tails in the workpiece. Jig 1 has six components: template 2, positioning members 4, side stop 6, beam 8, scab board 10, and backup board 12. Alternatively, the woodcutting jig 1 may be used as a bench mounted jig as shown in FIG. 13.

Figure 12:
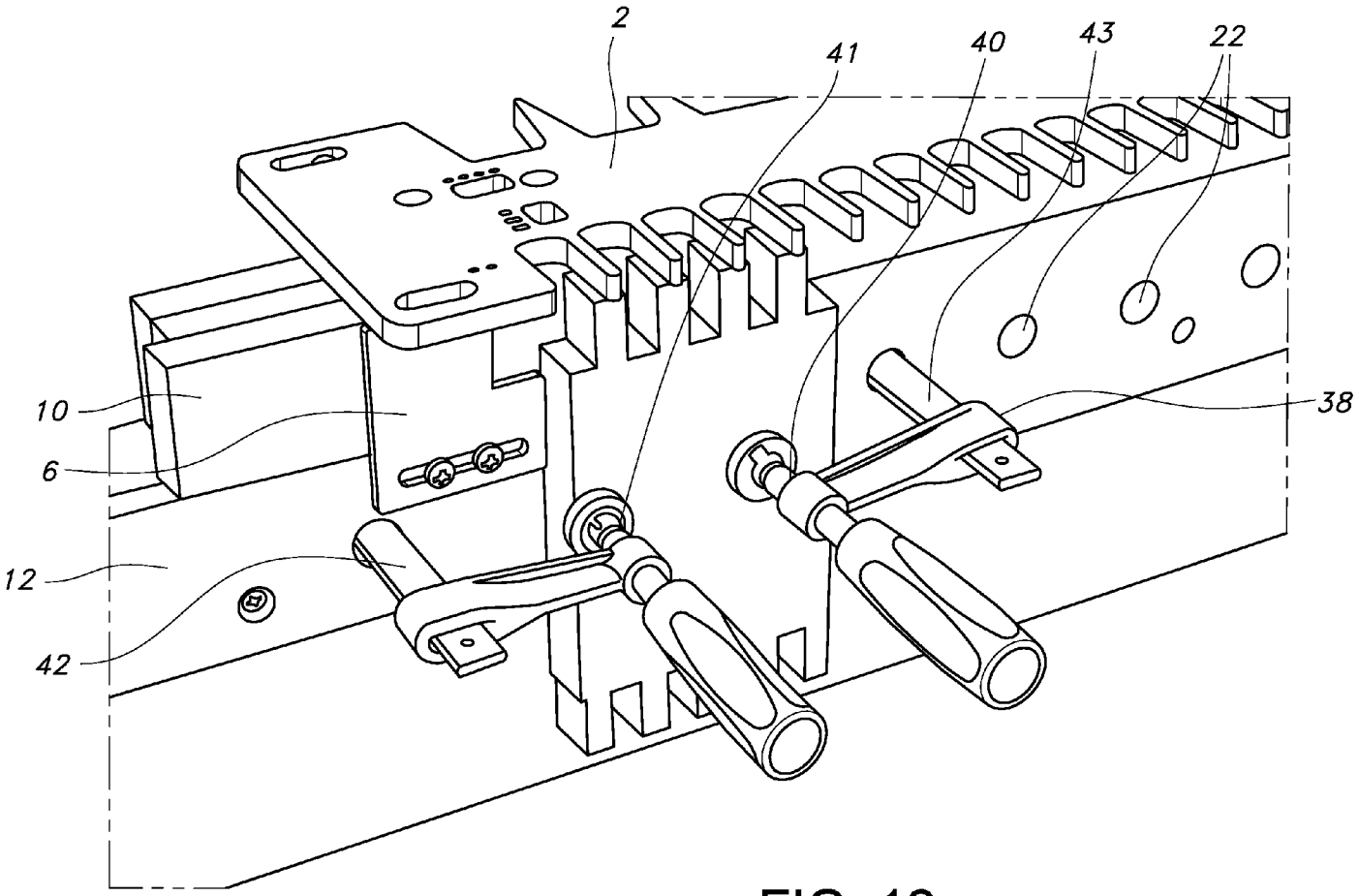
FIG. 12 is a view of the woodcutting jig shown in FIG. 1 with two clamps securing the workpiece for cutting box joints.

A workpiece is positioned against backup board 12 and scab board 10, as is depicted in FIG. 12, with a finger joint patterned template. The work piece is generally a rectangular board and clamps 38 secure the workpiece against backup board 12. In the embodiments in FIGS. 1 and 12, backup board 12 and beam 8 have a row of evenly spaced clamp holes 22 that can be used to attach clamps 38. Jaws 40 and 41 of clamp 38 bear against the front face of backup board 12, and the clamp bars 42 and 43 to which the jaws 40 and 41 attach pass from the rear through the holes 22 in beam 8 and backup board 12. Clamps 38 hold the workpiece against the scab board and backup board. After the workpiece is secured in place, a router (not shown) is used to cut pins and tails in the workpieces using a straight cutter for the pins and a dovetail shaped cutter for dovetail shaped tails.

Figure 5:
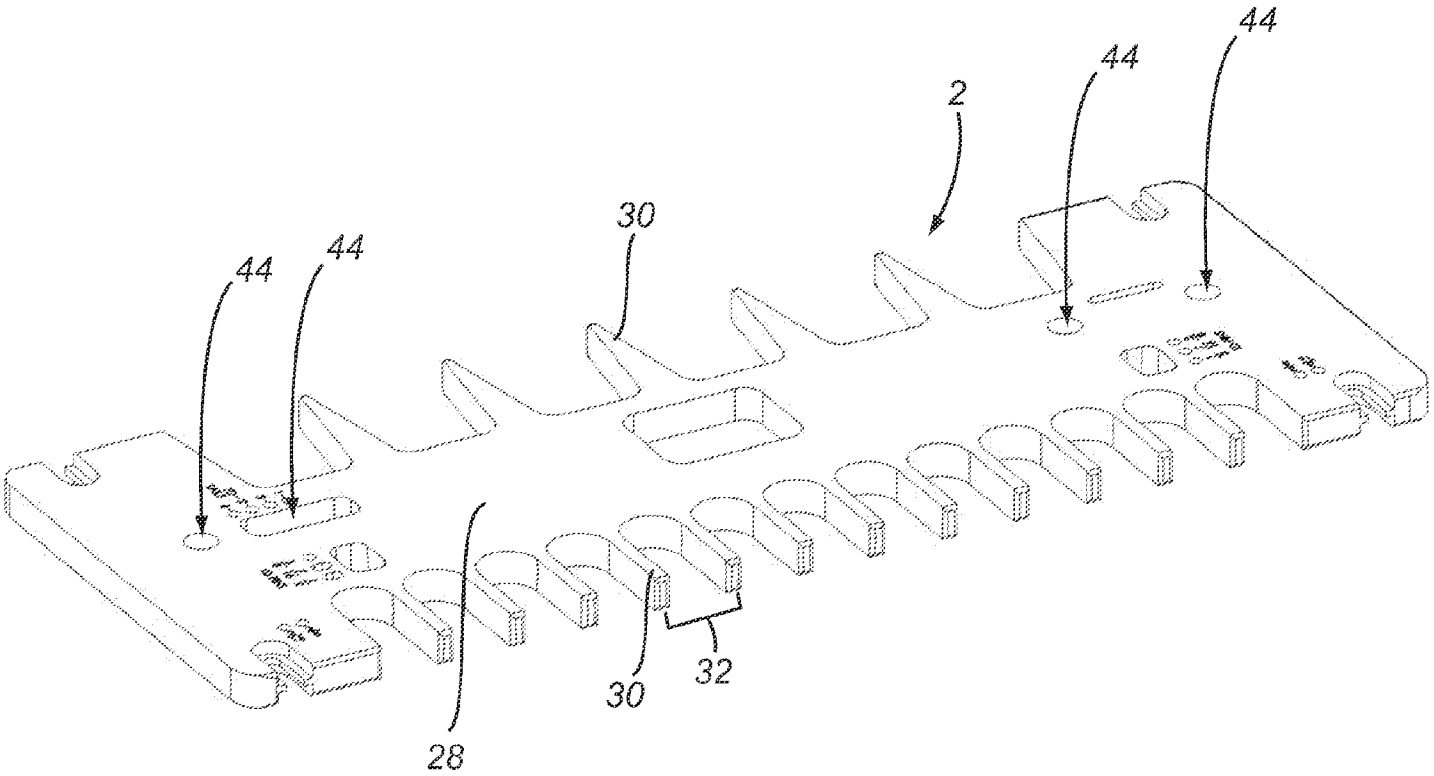
FIG. 5 is an enlarged isometric view of the template shown in FIGS. 1 and 4.
Figure 10A:
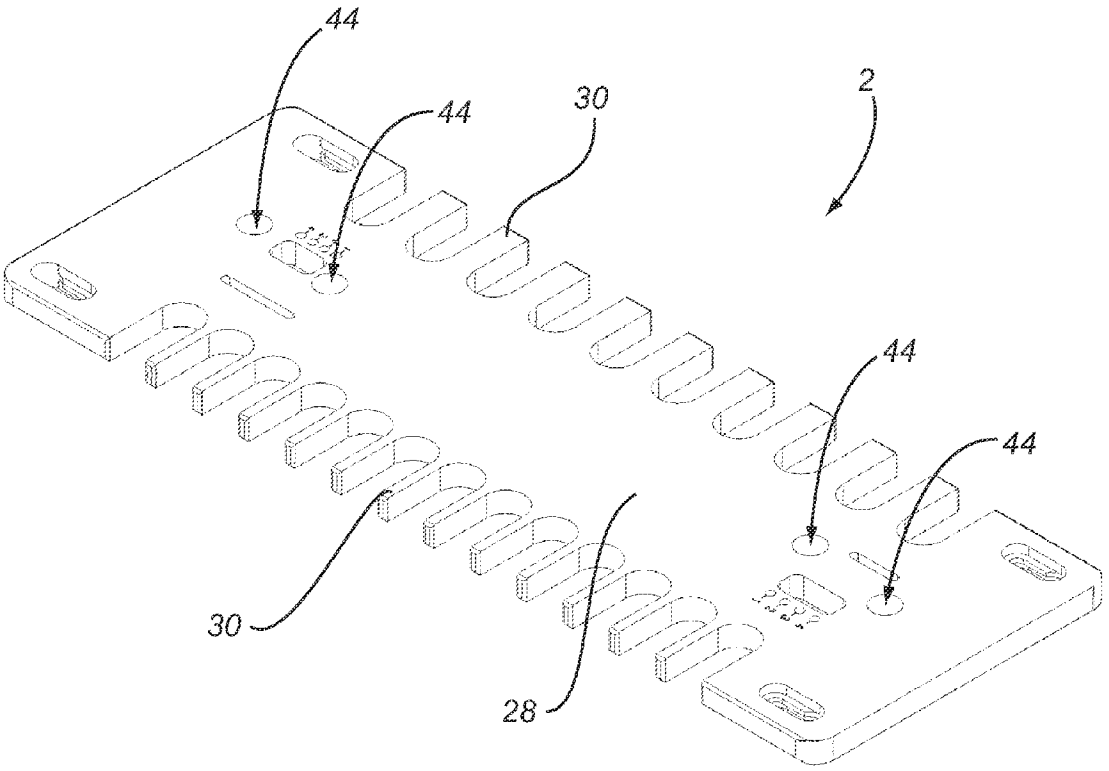
FIGS. 10A and 10B are views of different embodiments of the template.
Figure 10B:
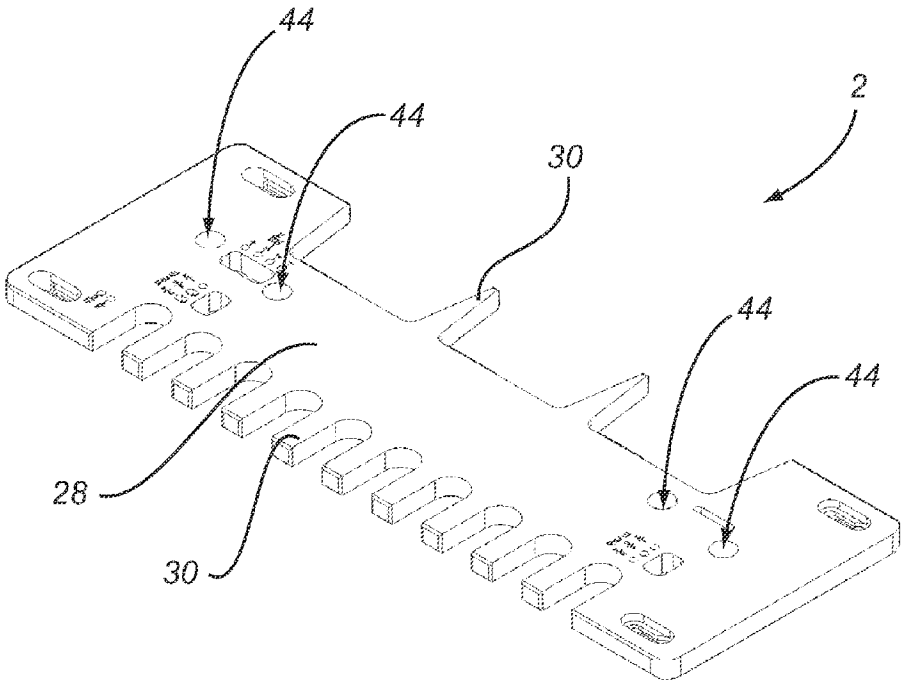

The path of the router is restricted by template 2. The template 2, depicted in FIG. 5, is relatively short and costs less than longer prior art templates. Template 2 has a planar surface 28 for supporting a cutting tool reference surface, such as a conventional electric router base, to cut joint members in workpieces positioned below template 2. Template 2 is formed with at least one set of protruding uniform fingers 30 defined by one or more surfaces orthogonal to the planar surface 28. A bushing mounted in an electric router base, or a bearing on the shank of a router cutter, (typically above the cutter blades) bears against the finger-defining surface to guide the cutting tool. Fingers 30 are spaced apart from adjacent fingers at a distance 32 equal to the pitch of the joint members to be cut, nominally twice the diameter of the router cutter. The design of the template allows other sets of guide fingers 30 to be formed on planar surface 28. Every set of guide fingers 30 is spaced and dimensioned to form joint members of a pre-determined pitch and size. Other embodiments of template 2 are shown in FIGS. 10A and 10B. Other embodiments of template 2 allow the cutting tool to vary the style and design of pin cuts and tail cuts, creating other dovetail joints.

As the pin and tail cuts are made, scab board 10, positioned under template 2 and abutting the workpiece, will be breached by the cutting tool. Scab board 10 is a replaceable board that can be removed without upsetting the positions of the other components by sliding scab board 10 longitudinally into or out of the jig assembly 1 between positioning beam 8 and side stop 6.

Figure 2:
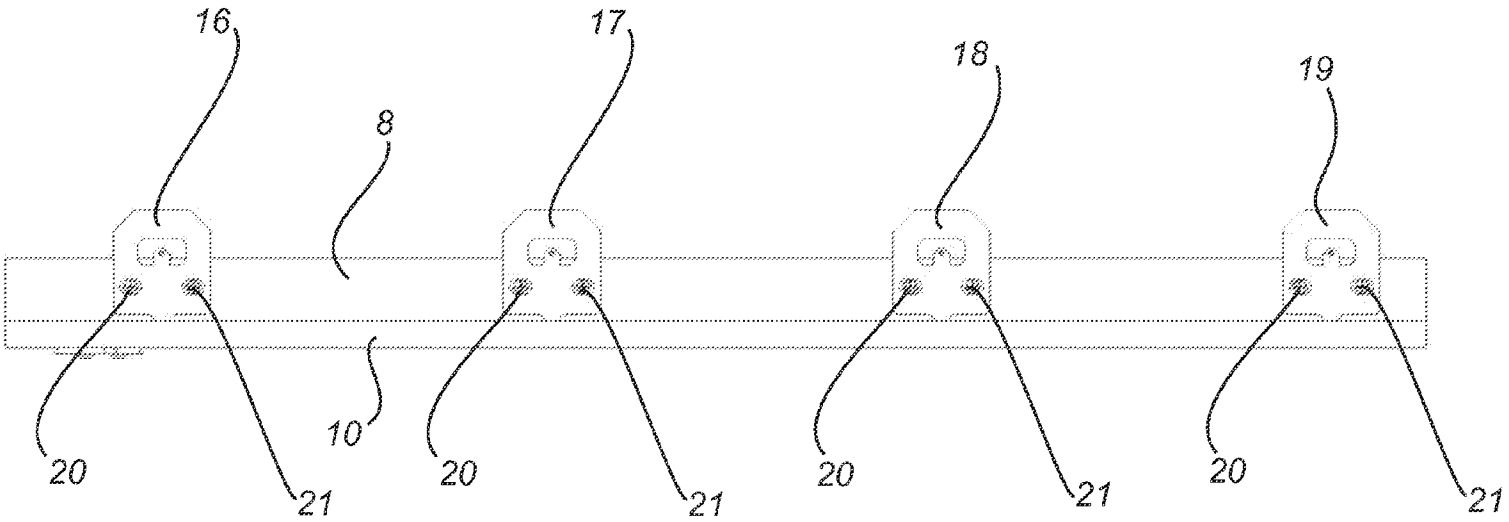
FIG. 2 is a top plan view of the woodcutting jig shown in FIG. 1 with the template removed.
Figure 3:
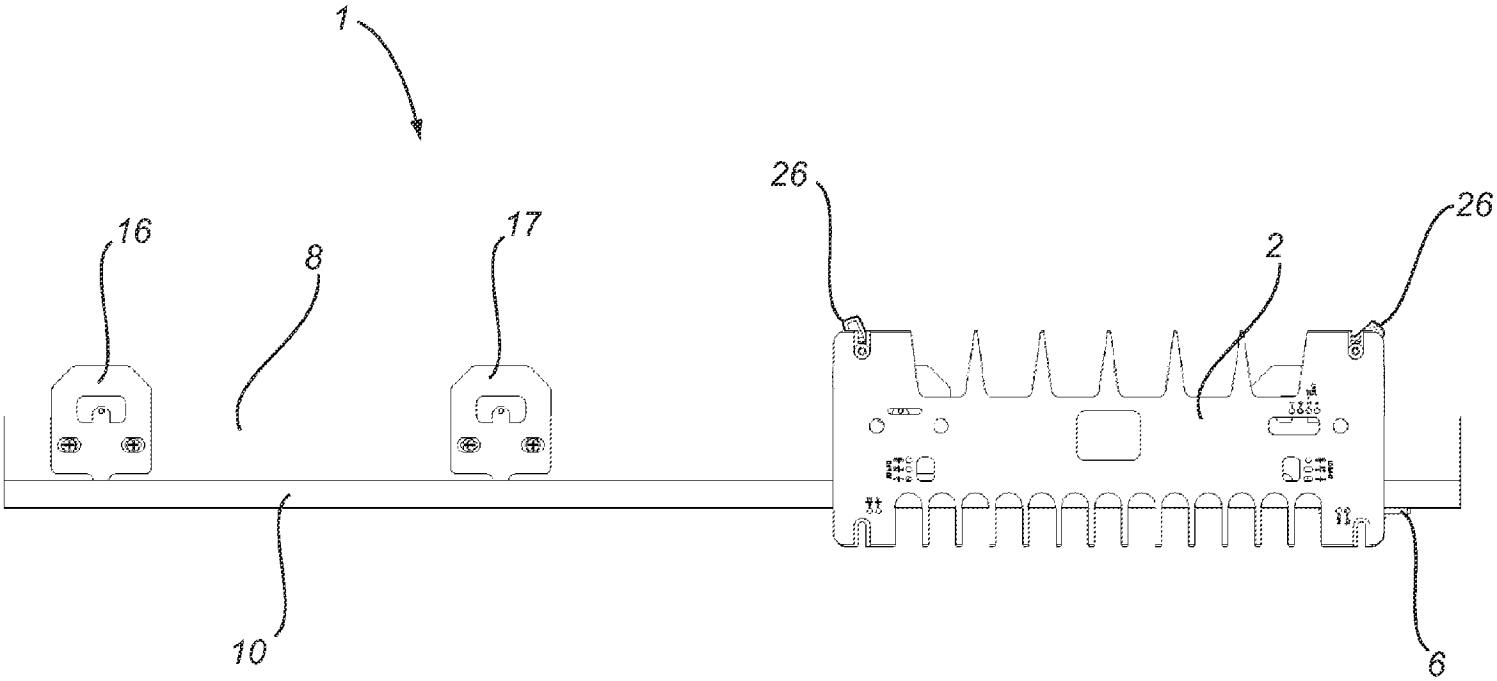
FIG. 3 is a top plan view of the woodcutting jig shown in FIG. 1.

Scab board 10 and/or backup board 12 may be made of medium-density fiberboard, an engineered wood product formed by breaking down softwood into wood fibers, combining it with wax and a resin binder, and forming panels by applying high temperature and pressure.

Where the workpiece is wider than template 2, template 2 can be "stepped over" to accurately cut the pins and tails In FIG. 2, beam 8 and scab board 10 are shown with four pin plates, 16, 17, 18, 19. Fewer or more pin plates can be used depending on the width of the workpiece. As shown in FIG. 2, pin plates 16, 17, 18, 19 are spaced equal distances apart on positioning beam 8. Anchoring screws 20, 21 secure each pin plate 16, 17, 18, 19 into positioning beam 8, but any other appropriate fastener can be used.

Figure 6:
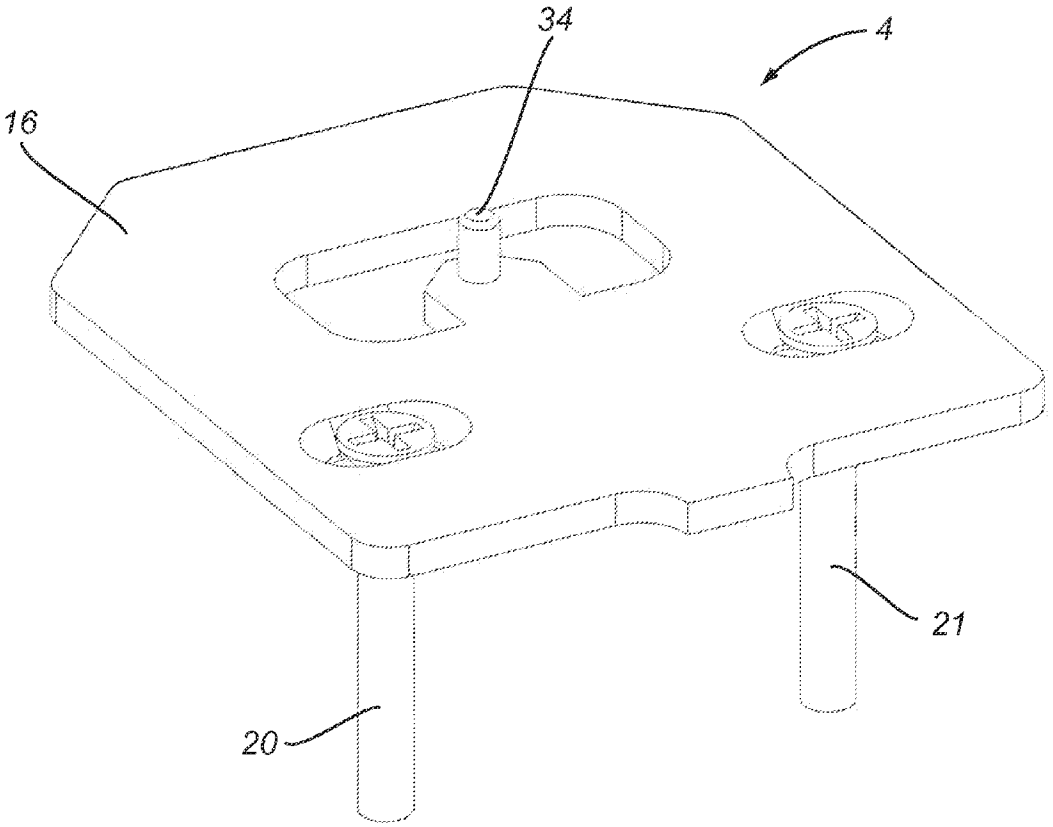
FIG. 6 is an enlarged isometric view of one of the pin plates depicted in FIG. 4.
Figure 8:
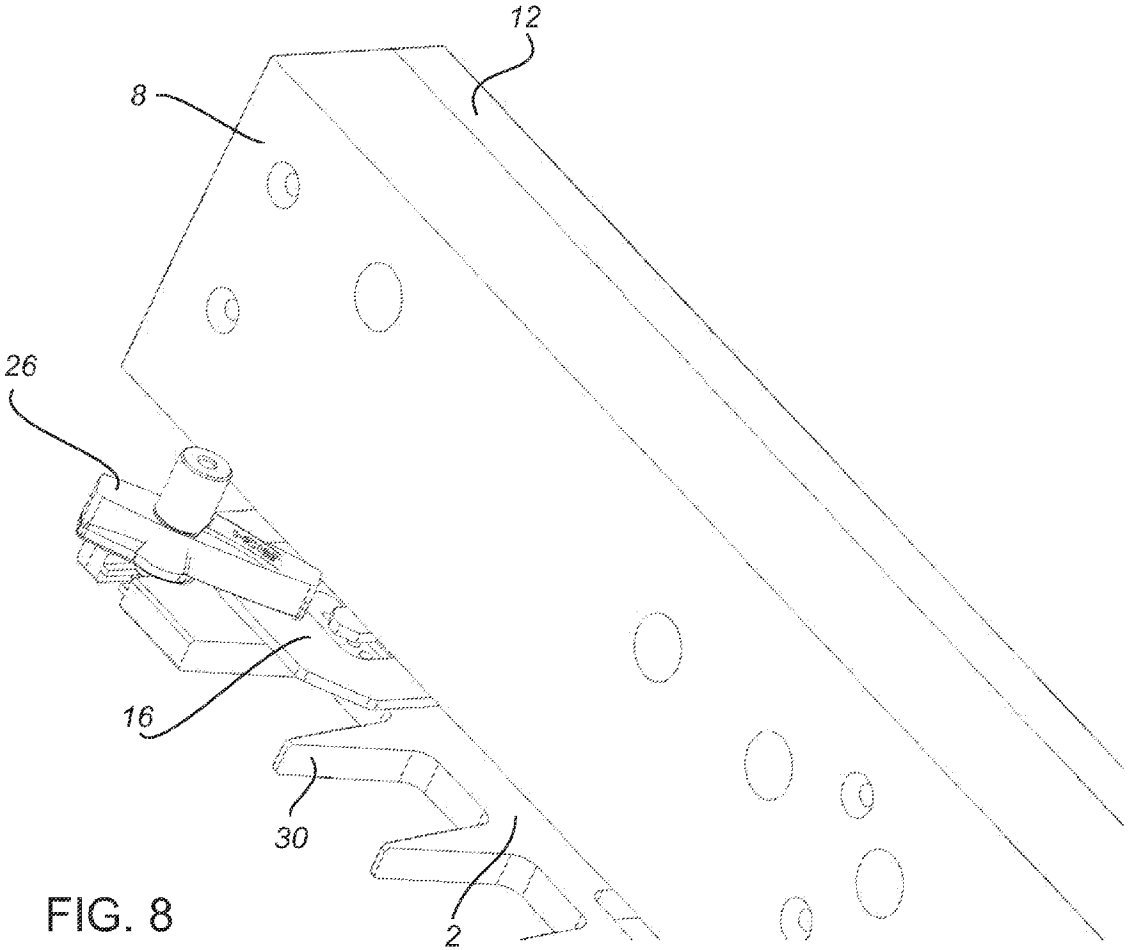
FIG. 8 is an isometric view of a portion of the underside, pin side, and an end of a locking mechanism of the embodiment depicted in FIG. 1.

Pin plates 16, 17, 18, 19 have anchoring screws 20, 21 and indexing pin 34 as depicted in FIG. 6. In some embodiments, pin plates 16, 17, 18, 19 are made of steel. In these embodiments, template 2 can be attached to one embodiment of pin plates 16, 17, 18, 19 made of steel either by powerful rare earth magnets set flush with, or just below planar surface 28, by mechanical means sliding clips, or by turn buckle clips. Indexing pin 34 retains template 2 horizontally, creating a very secure set-up that is quick and easy in use. Indexing pin 34 also provides precise Y-axis template positioning (relative to the front face of woodcutting jig 1) for routing dovetail pins. Lock 26 shown in FIG. 8 is one mechanical means of securing template 2 to the pin plates 16, 17, 18, 19.

Figure 9:
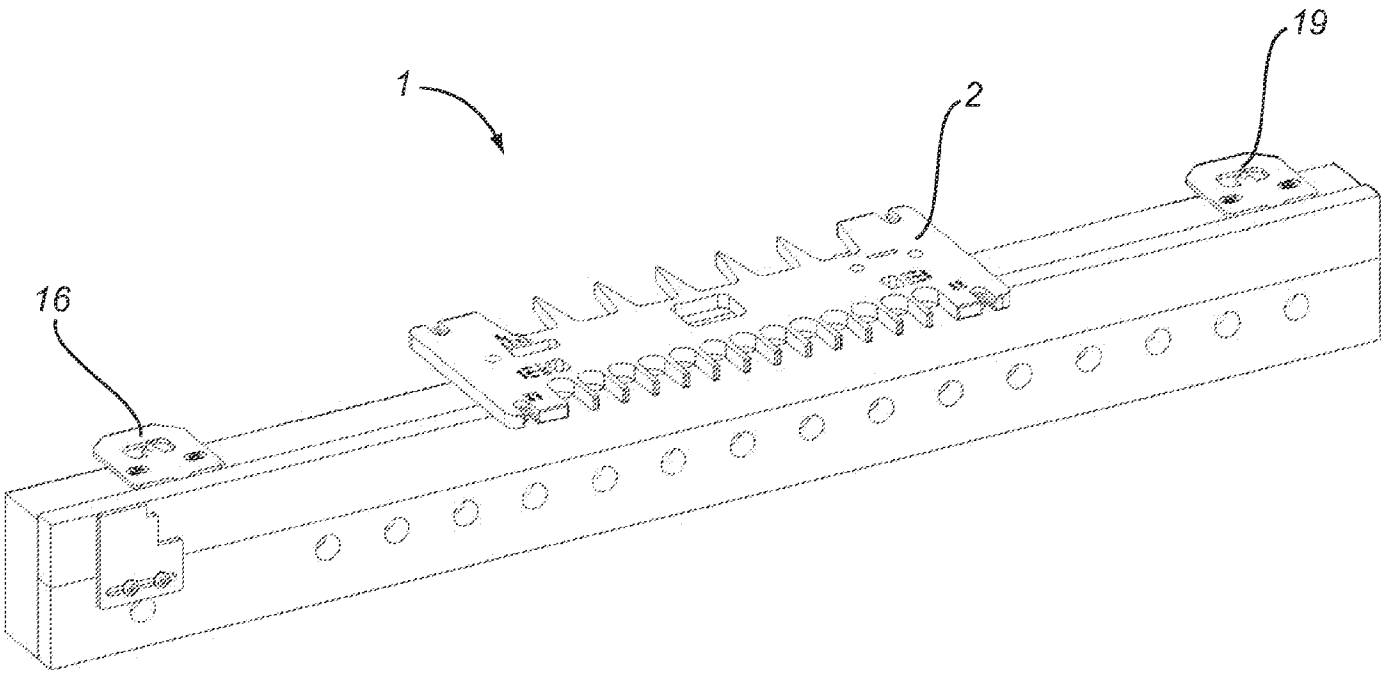
FIG. 9 is an isometric view of the tail face, top, and one end of the embodiment of the mounted woodcutting jig depicted in FIG. 1 with the template stepped over from the side stop.
Figure 11:
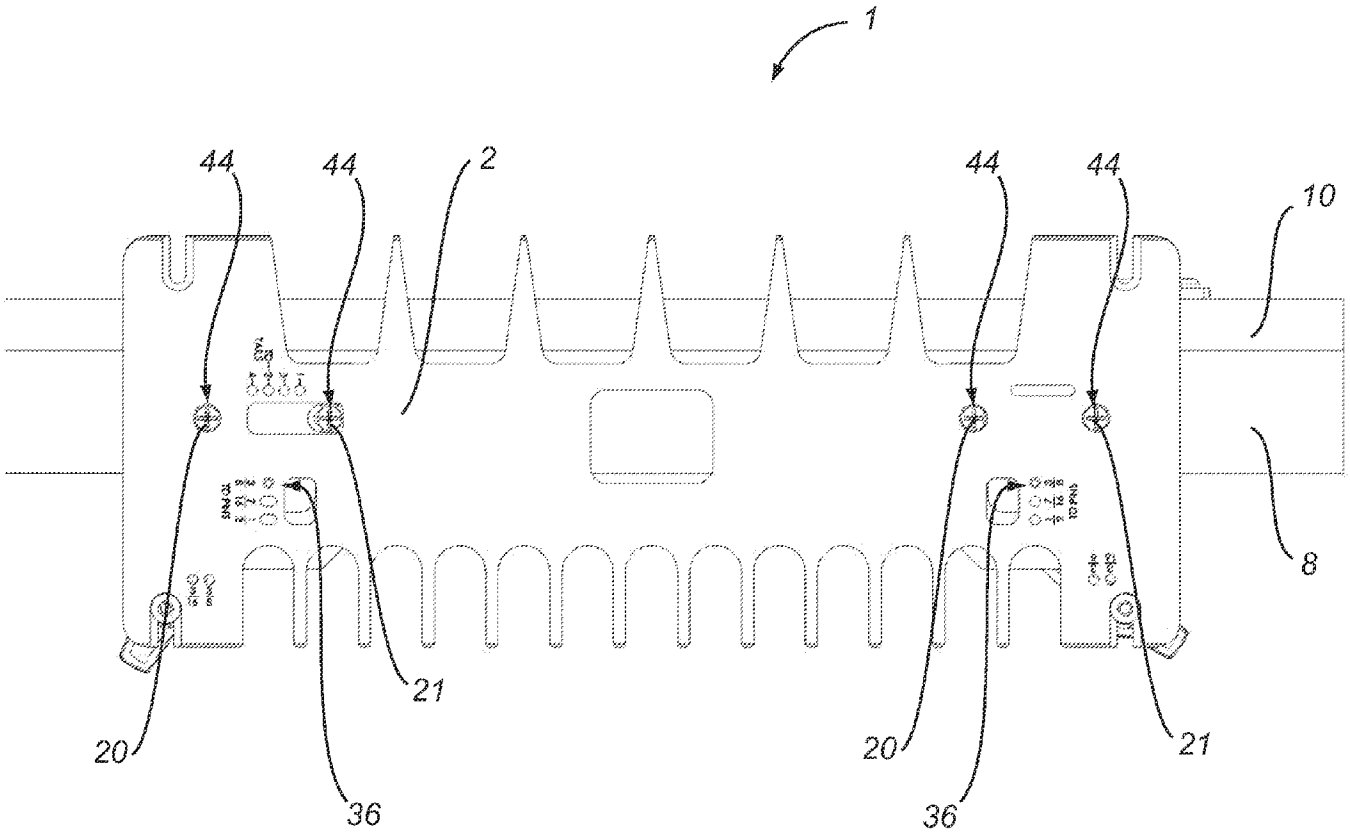
FIG. 11 is a top plan view of the woodcutting jig shown in FIG. 1 with the template positioned to set the location of the positioning members.

Template 2 may be used to establish the appropriate distance between the pin plates 16, 17, 18, 19 as depicted in FIG. 11. Pin plate 16 (not shown in FIG. 11) is positioned on positioning beam 8, and template 2 is positioned as shown in FIG. 11, with the proper location of pin plate 17 shown through template holes 36 on template 2. After pin plate 17 has been secured to beam 8, the template 2 can be stepped over, as shown in FIG. 9, to locate pin plate 18 at the appropriate distance from pin plate 17. When connected to pin plates 16 and 17, template 2 is aligned with side stop 6.

Side stop 6 has side stop screws 14 which penetrate through side stop 6 and backup board 12 into positioning beam 8 to attach side stop 6 to positioning beam 8 as depicted in FIG. 1. Further, side stop 6 orients the workpiece with respect to template 2, backup board 12, scab board 10, and positioning beam 8.

When measuring the distances between pin plates 16, 17, 18, 19, the user utilizes template holes 36 in template 2 to determine a location to insert anchoring screws 20, 21 in this embodiment. The user then "steps over" template 2, and determines the next location of the anchoring screws 20, 21.

The "step over" functionality allows template 2 to be used to cut joints into workpieces wider than template 2 because the positioning of pin plates 16, 17, 18, 19 and anchoring screws 20, 21 is provided by positioning holes 44 in template 2. The user can precisely adjust the positions of pin plates 16, 17, 18, 19. Furthermore, measuring the distance between pin plates 16, 17, 18, 19 using template 2 maintains accuracy in the pin and tail interaction despite any positioning beam expansion or contraction that may occur between uses.

Figure 4:
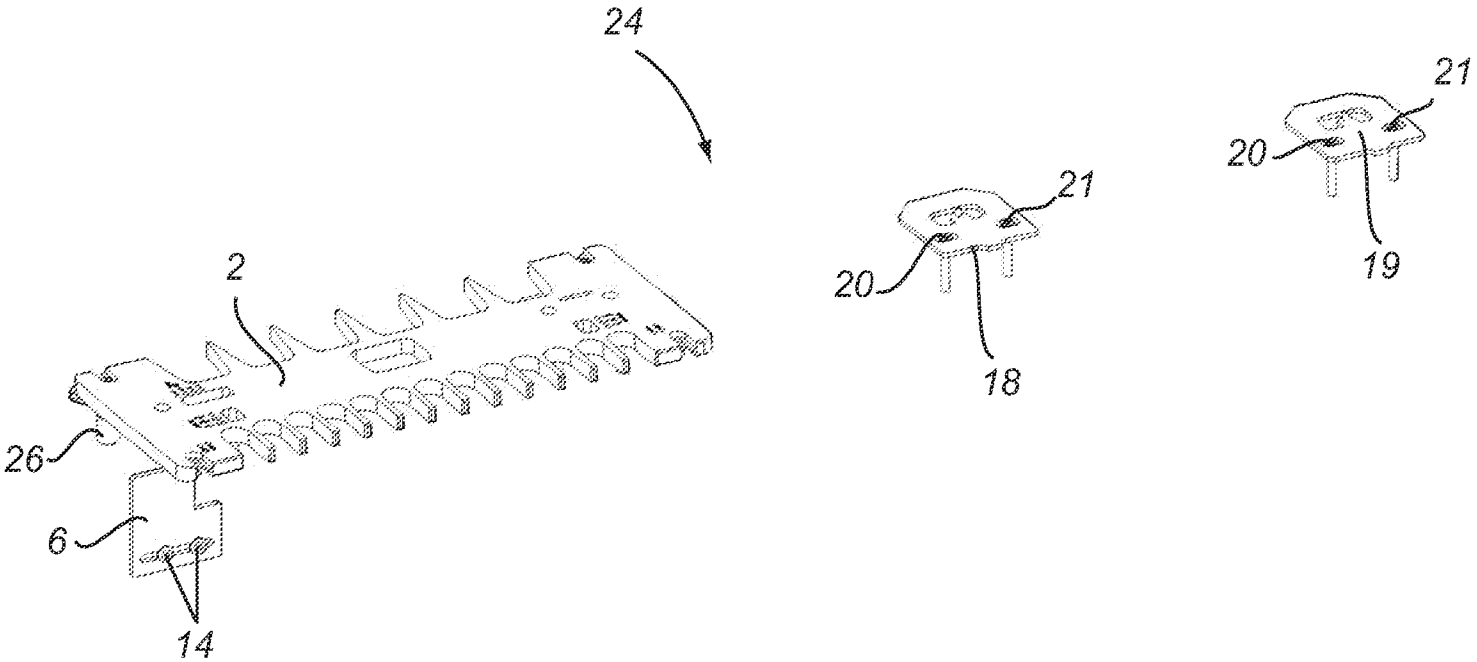
FIG. 4 is the same view of the components of the woodcutting jig kit of this invention shown in FIG. 1, but without the positioning beam, scab board, or backup board.

Components for a woodcutting jig 1 may be provided as a kit 24, depicted in FIG. 4, reducing its size and cost. Such a kit 24 may include the following components: pin plates 16, 17, 18, 19, template 2, side stop 6, at least one lock 26, and other fastening devices. Side stop screws 14 and anchoring screws 20, 21 are conventional wood screws that optionally might not necessarily be supplied with kit 24 components. Thus, the screws are not necessarily provided in the kit.

Figure 14:
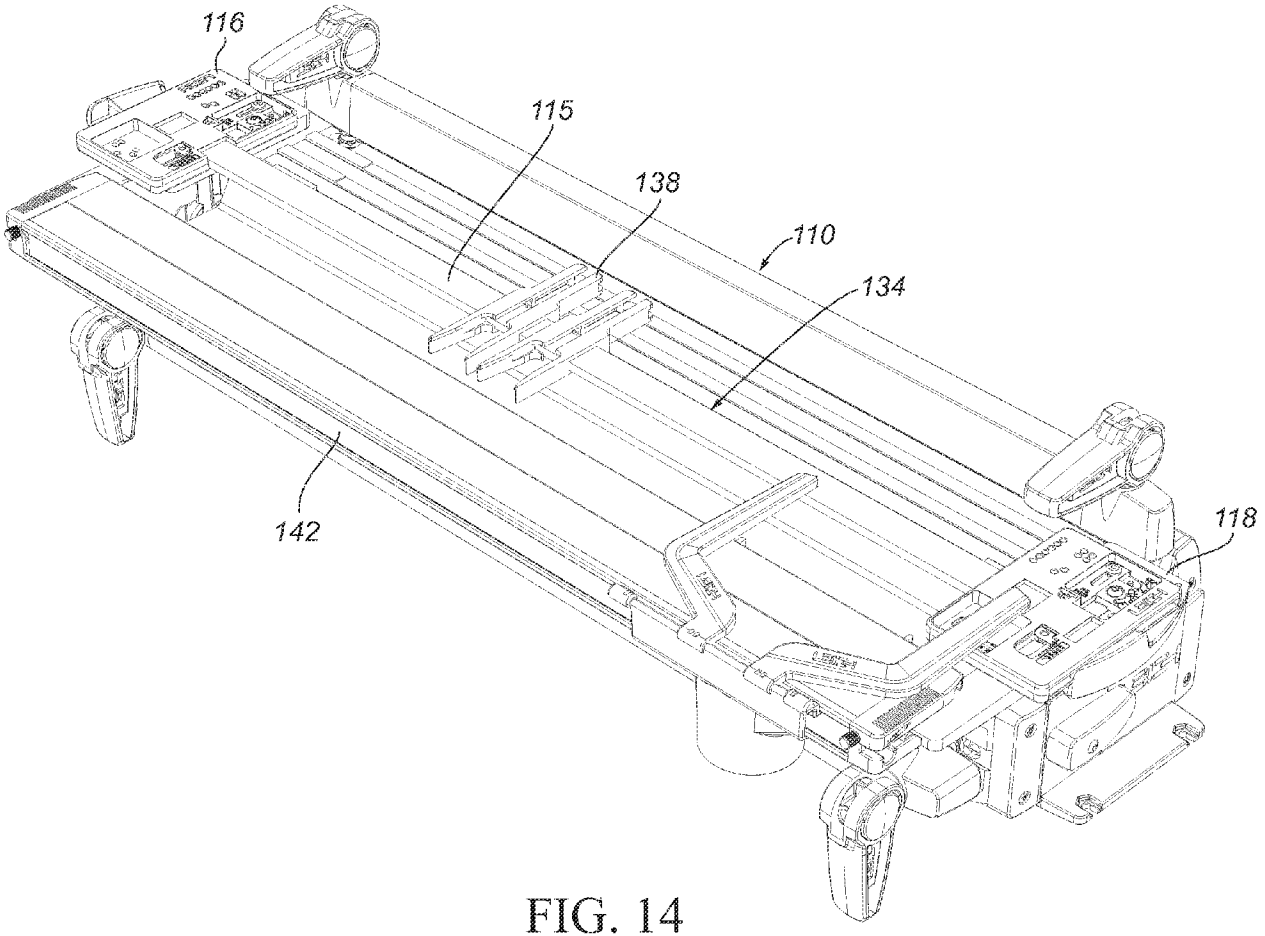
FIG. 14 is a perspective view of the top, front and right end an embodiment of the joint making jig of this invention with a finger assembly with joint-making fingers, clamps and dust removal accessories attached.
Figure 15:
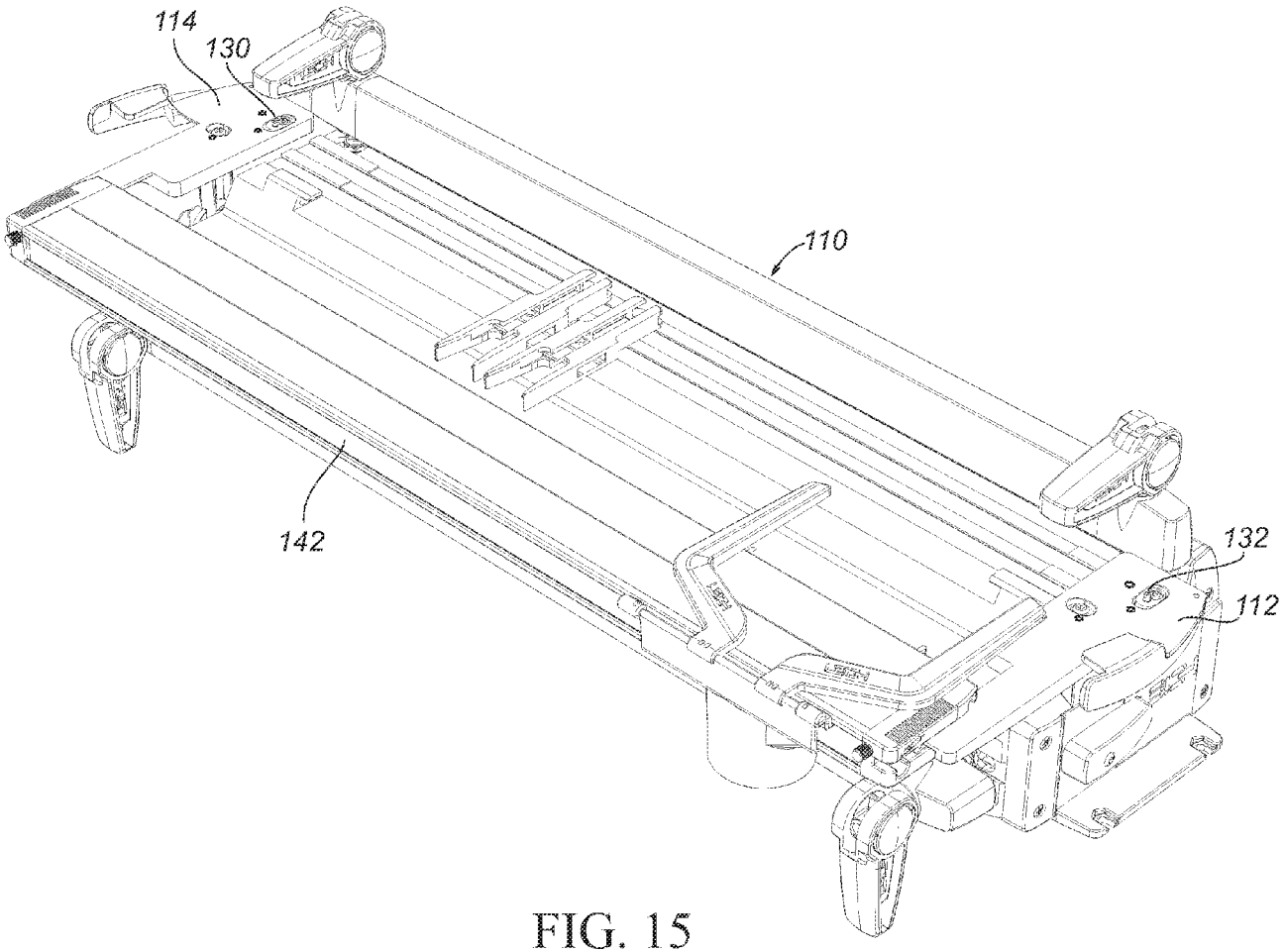
FIG. 15 is a perspective view of the top, front and right end of the embodiment of the joint making jig of this invention shown in FIG. 14 together with clamps and dust removal components but showing only a portion of the finger assembly.
Figure 24:
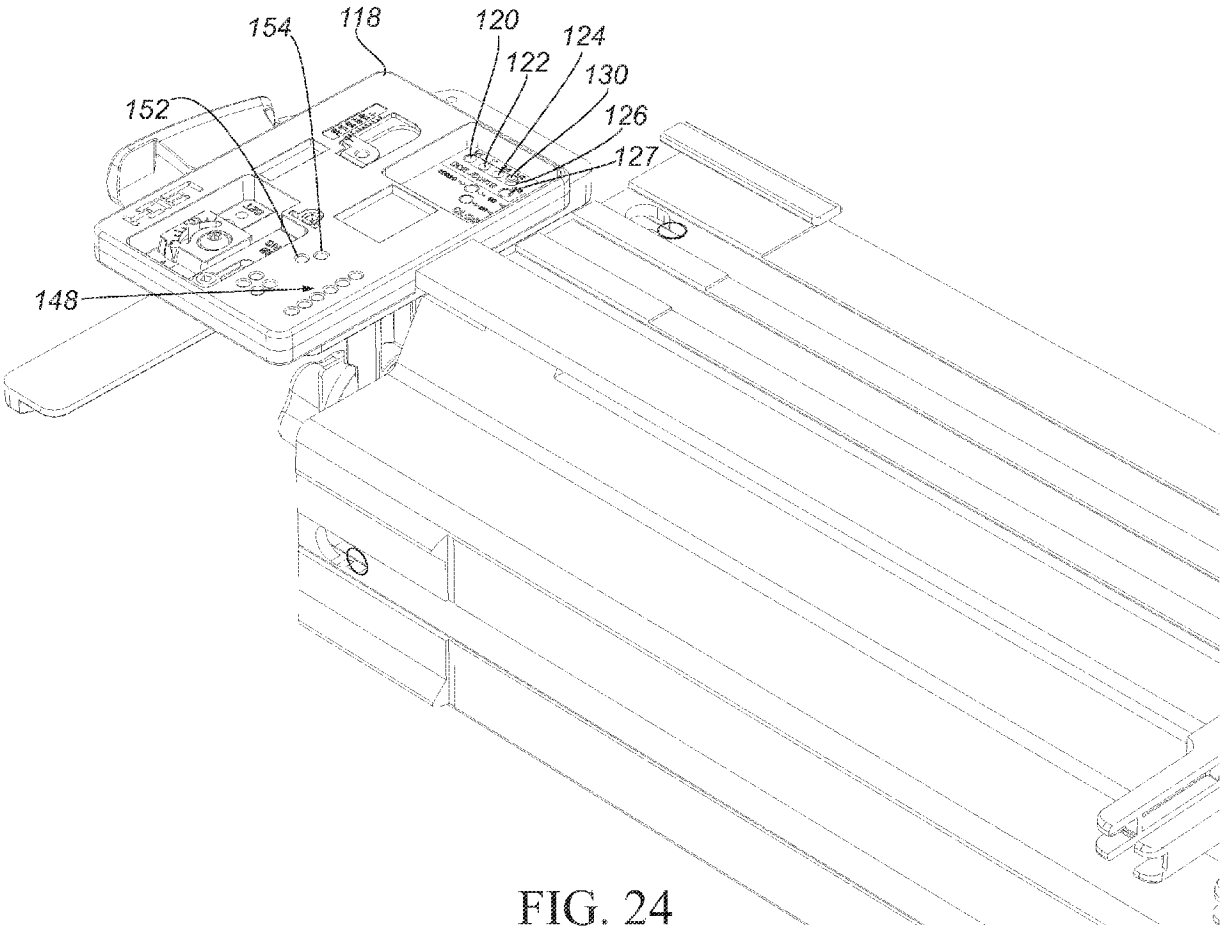
FIG. 24 is an enlarged segment of FIG. 21 showing the left end of the jig configured for cutting ½" box joints.
Figure 25:
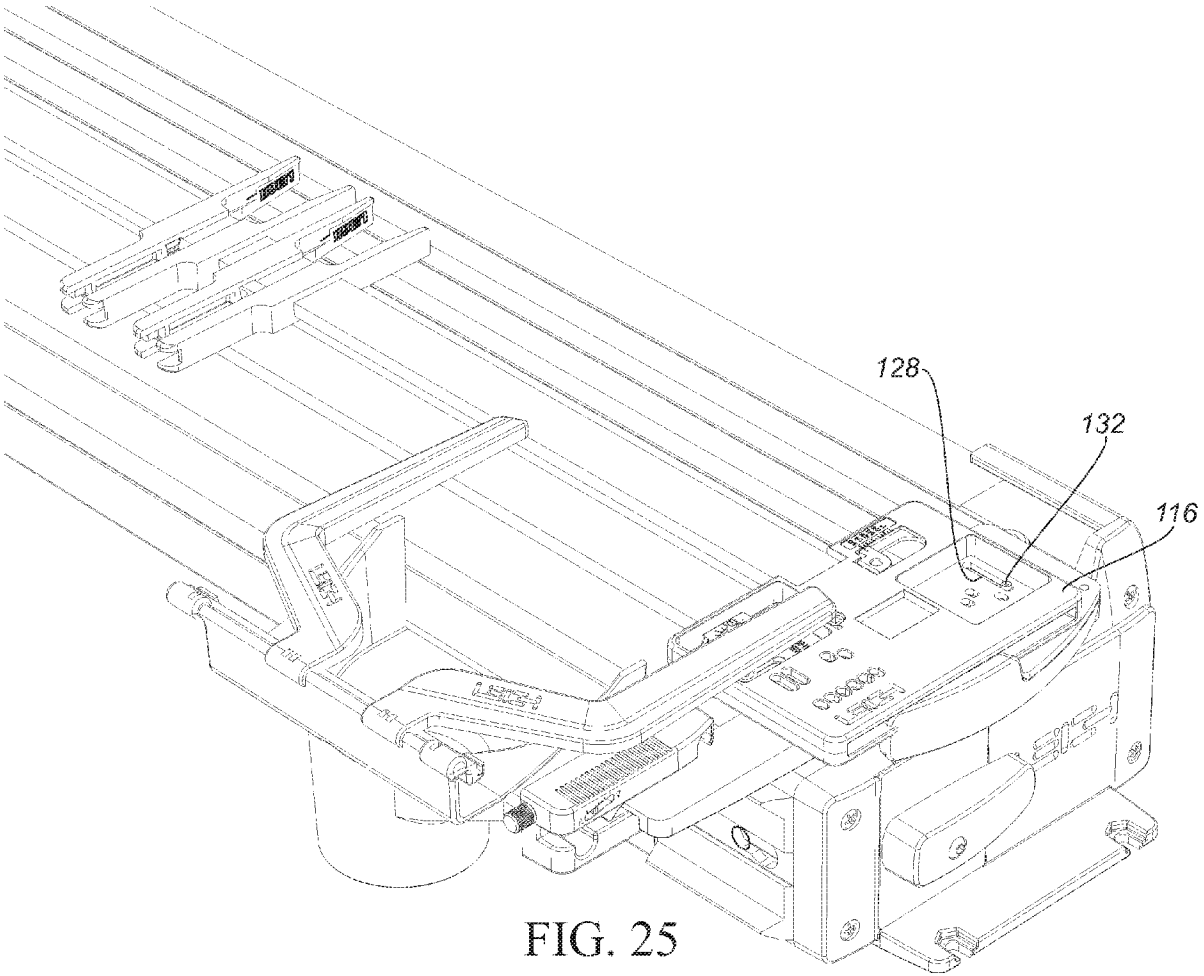
FIG. 25 is an enlarged segment of FIG. 21 showing the right end of the jig configured for cutting ½" box joints.
Figure 26:
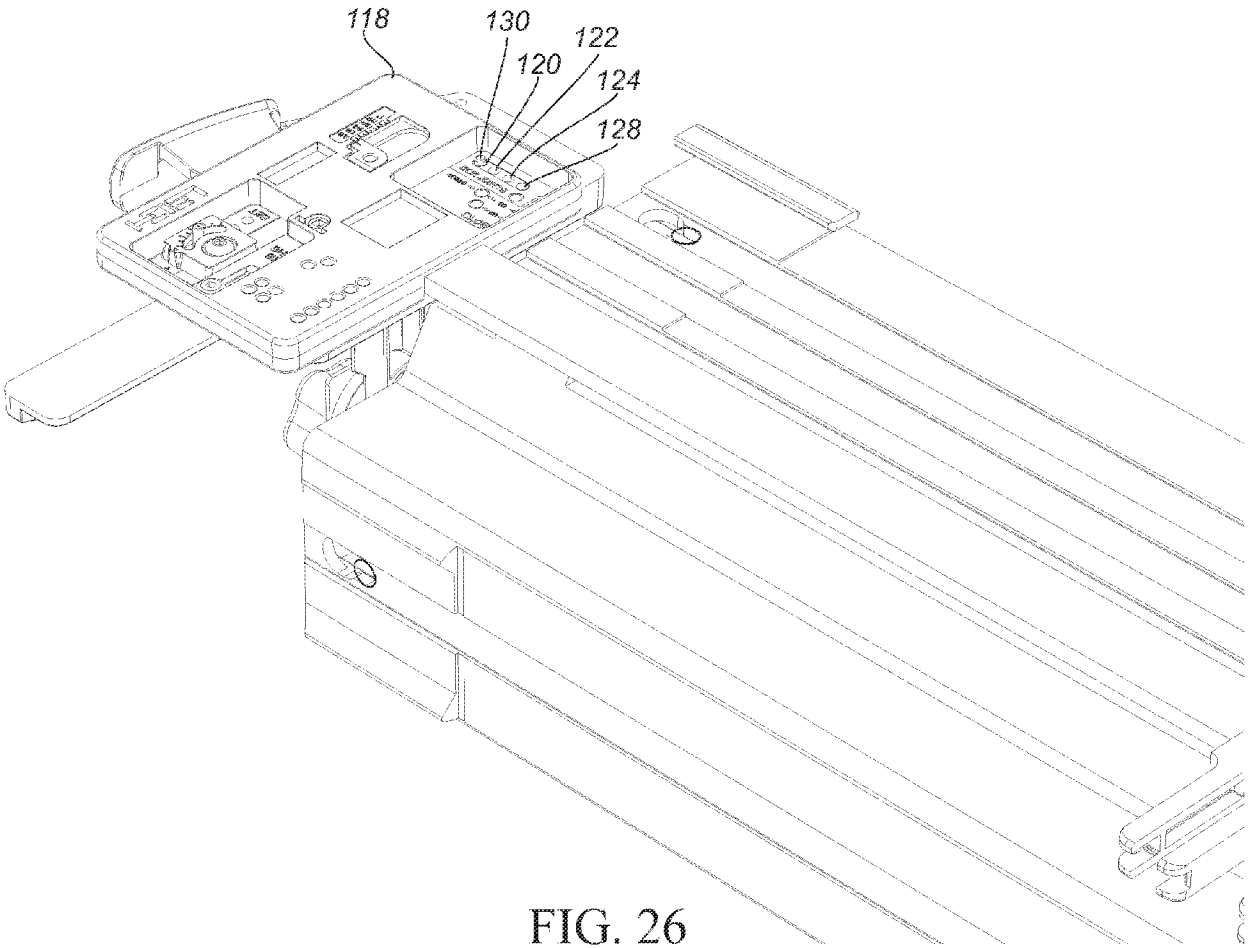
FIG. 26 is an enlarged segment of FIG. 22 showing the left end of the jig configured for cutting 1¼" box joints.

Another exemplary embodiment 110 of the joint making jig of this invention has horizontal platforms 112 and 114 easily seen in FIG. 15 at each jig 110 end on top of vertically adjustable posts 117 (one of which is visible in FIG. 15). Index blocks 116 and 118 (shown in FIG. 14 and other FIGS.) at the end of a finger-holding bar 115 contain pin holes 120, 122, 124, 126 and 127 (FIG. 24) and slots 128 (FIG. 25) (as well as other openings) described in more detail below.

Generally, an index pin hole in the index block 116 or 118 positioned on the left side of the jig 110 as shown in the drawings fits over a single pin 130 on the left platform 114 and thereby fixes the left-right position of the finger assembly 134. A corresponding slot such as slot 128 in the right hand index block as shown in the drawings fits over a similar pin 132 in the right-hand platform 112 and thereby controls the front-back position of finger jig 134. Pin holes and slot positions could as easily be reversed right for left. Furthermore, pin holes could be used on both index blocks rather than slot on one index block.

Each pair of pin holes 120, 122, 124, 126 and 127 and slot 128 or other pin holes and slots precisely position the finger assembly 34 for a specific joint mode, joint type and joint size.

Joint fit adjustment may not be needed. If joint fit adjustment is needed, it does not need to be provided by making finger assembly 134 adjustable. This is possible because adjustability can be achieved by use of an adjustable guide such as the adjustable guide bushing disclosed in U.S. Pat. No. 8,256,475 and U.S. patent application Ser. No. 13/566,345 filed Aug. 3, 2012 (Patent Publication no US 2012/029192, published Nov. 22, 2012), which are incorporated herein in its entirety by this reference.

Jig Set Up

Figure 16:
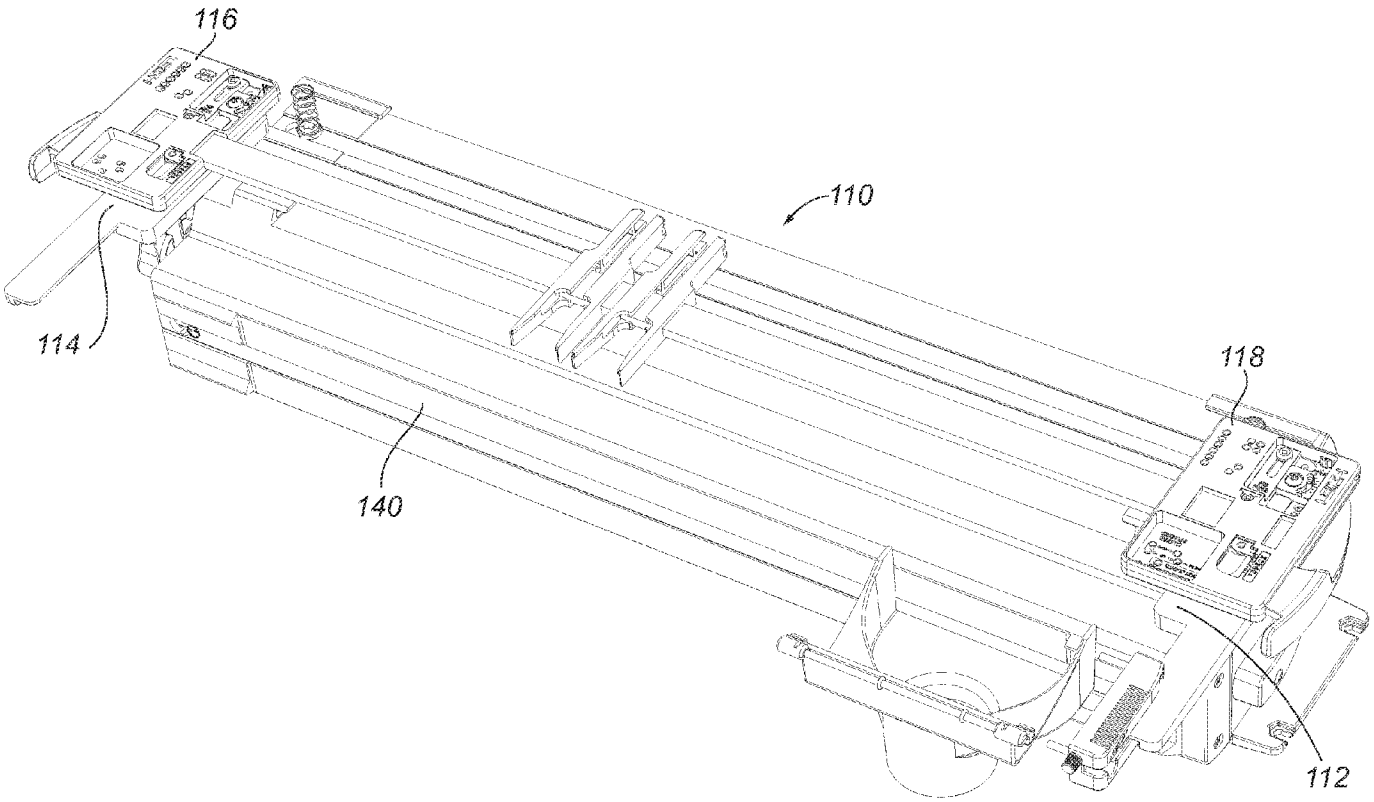
FIG. 16 is a perspective view of the top, front and right end of the embodiment of the joint making jig shown in FIG. 14 configured for set up but with clamps and dust removal supporting structure omitted for clarity.
Figure 23:
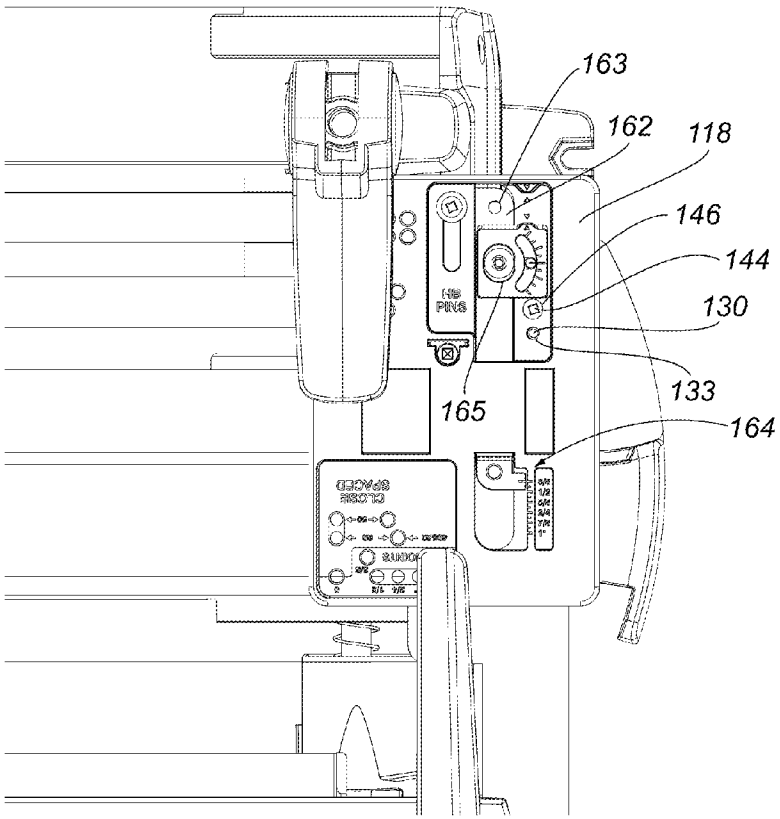
FIG. 23 is an enlarged segment of the joint making jig showing in plan the right hand end of the jig in "set up" mode.
Figure 27:
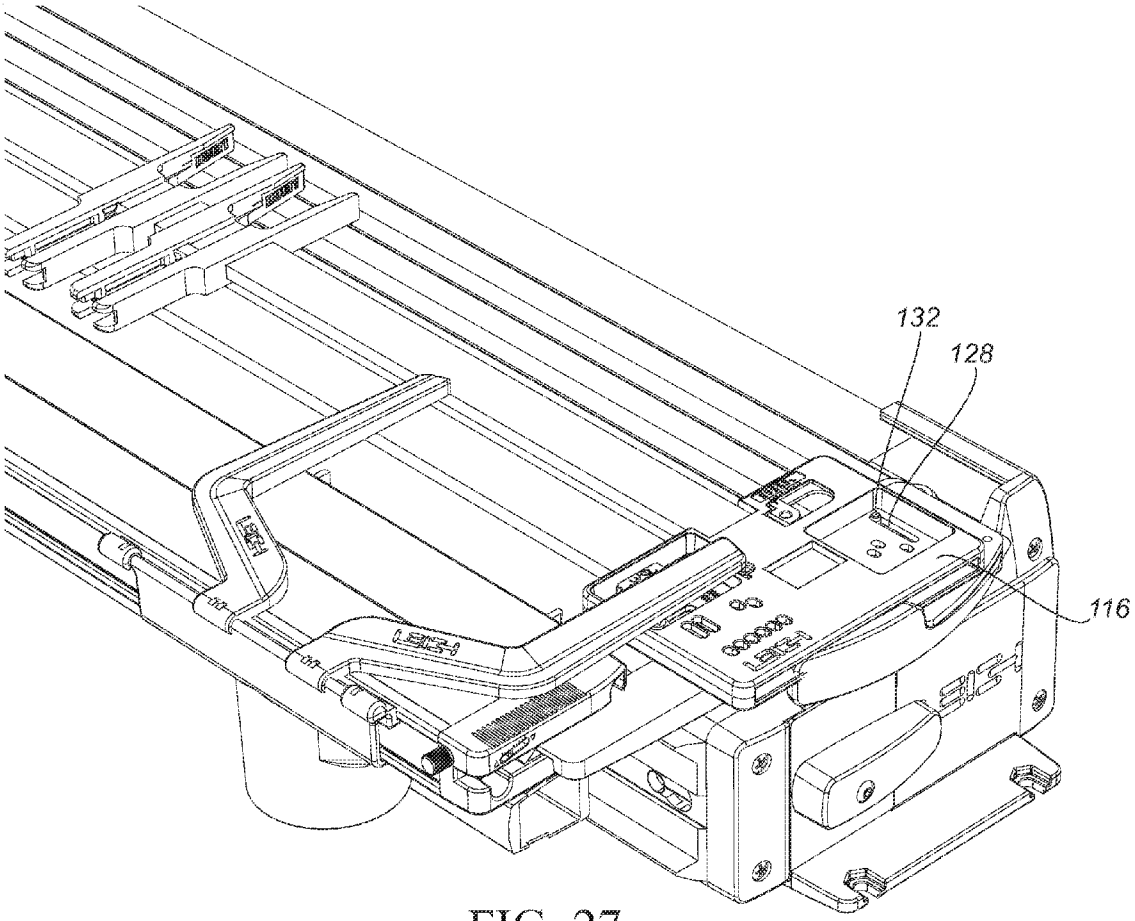
FIG. 27 is an enlarged segment of FIG. 22 showing the right end of the jig configured for cutting 1¼" box joints.
Figure 28:
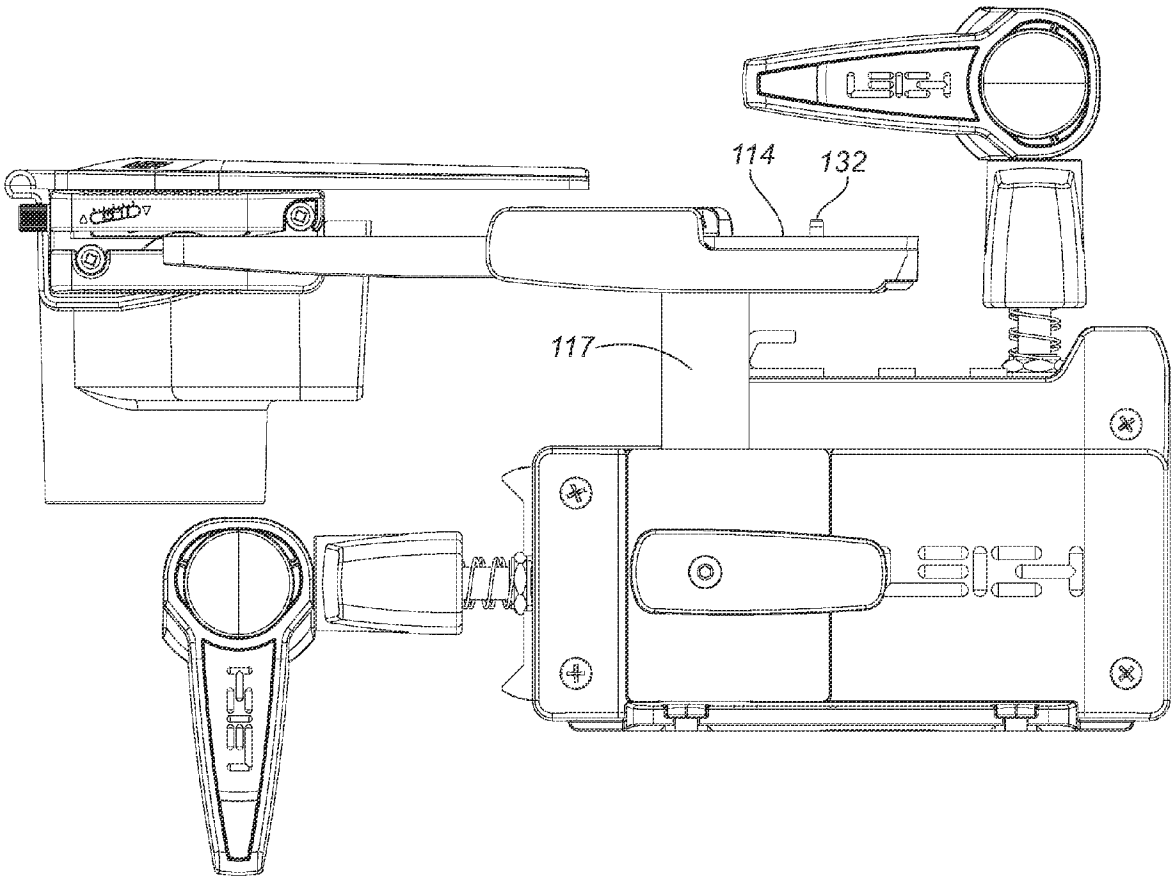
FIG. 28 is an end elevation view of the right end of the jig shown in FIG. 15.

To accurately position the finger assembly 34 both front-to-back and parallel to the jig 110 front face, the index blocks 116 and 118 include set-up holes 131 and 133 (see FIGS. 27 and 23). The platform pins 130 and 132 are loosened, and the finger assembly 134 is placed on the jig platforms 112 and 114 with the pins 130 and 132 received in set-up holes 131 and 133. The finger assembly 134 is then moved forward until the tips 136 of the guide fingers 138 touch the rear of a board or boards (not shown) held against face 140 (FIG. 16) of the jig 110 front clamp bar 142 (clamp bar 142 is not in FIG. 16 but it is in FIGS. 14 and 15). The pin lock screws 144 are then tightened through the screwdriver access holes 146 visible in FIGS. 15 and 23.

Through Dovetail Tails

Figure 29:
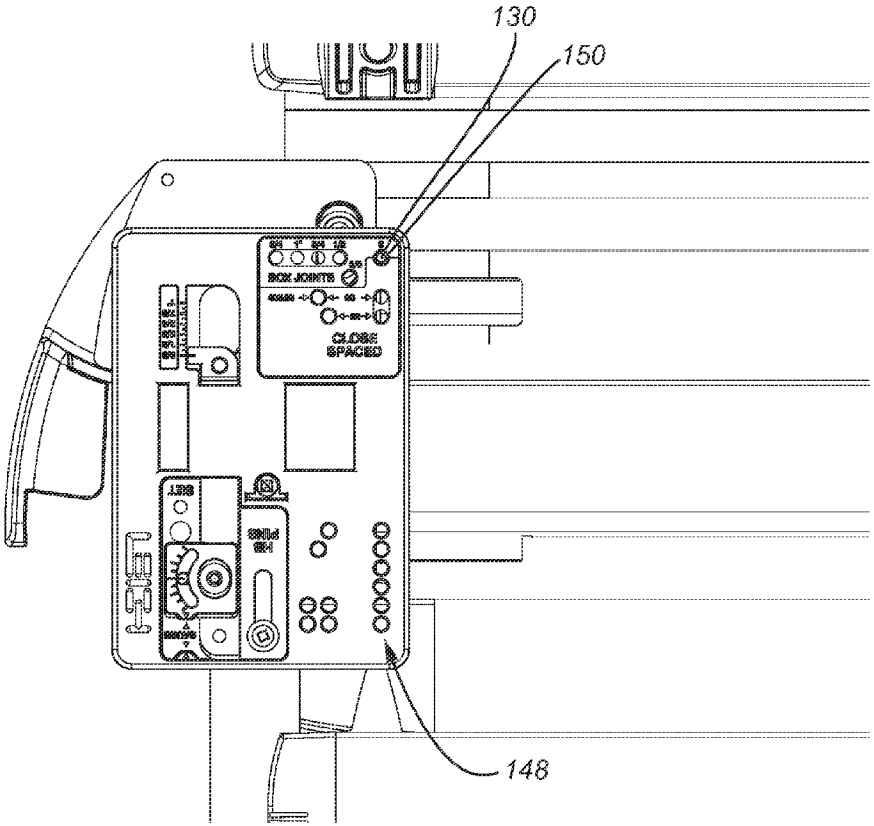
FIG. 29 is a plan view of the left end of the joint making jig embodiment shown in FIG. 14 with an index finger assembly positioned for forming through dovetail joint tails.

Through dovetail tails are cut with the finger assembly 134 positioned with the left pin 130 received in the through dovetail tails pin hole 150 in index block which is at the rear right of the left index block 118 in the through dovetail tails joint mode shown in FIG. 29. This brings the finger assembly 134 at its furthest forward position to place the full length of the tail 134 guide surfaces over a vertical work piece (not shown). All through dovetail tails are routed in this position, regardless of size. Note that at the bottom right hand corner of the index block 118 (best seen in FIG. 24) is the row 148 of through dovetail pin holes that are in line with the tail hole 150.

Through Dovetail Pins

Figure 18:
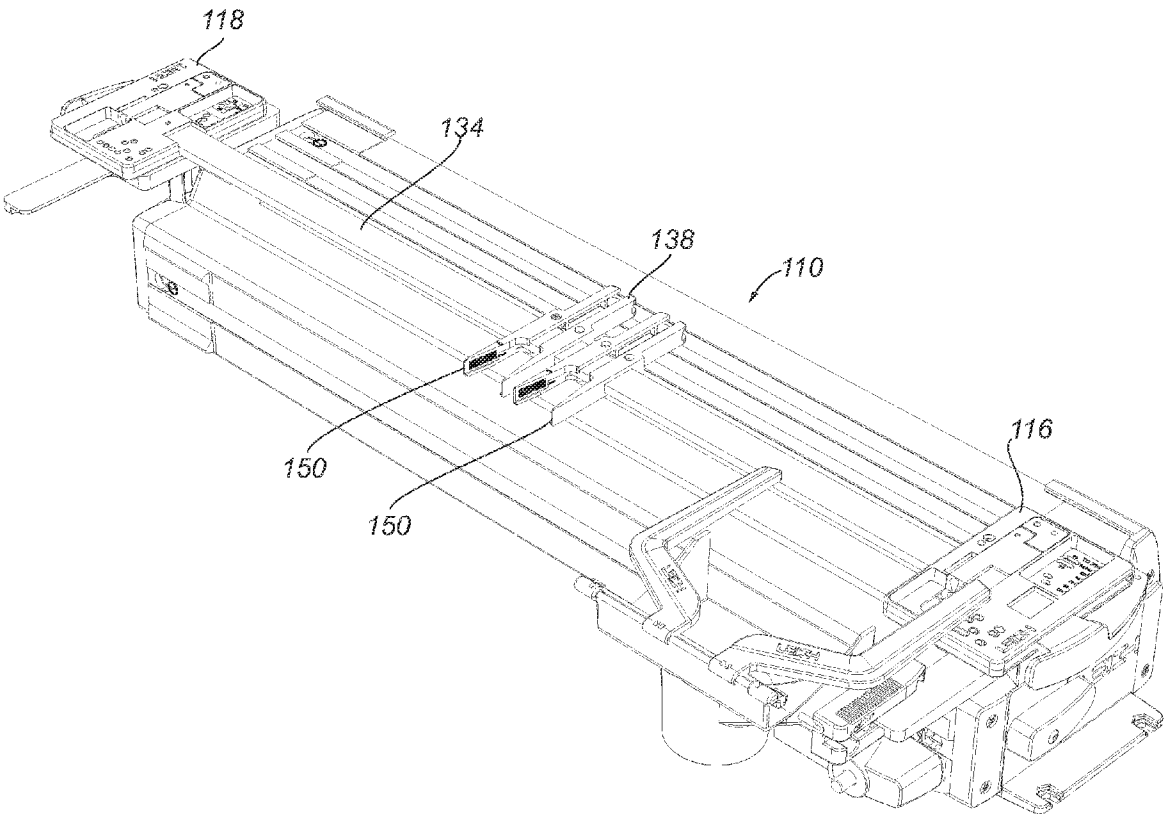
FIG. 18 is a perspective view of the top, front and right end of the joint making jig embodiment shown in FIG. 14 with a an index finger assembly configured for producing through dovetail joint pins.

After through dovetail tails are cut, the finger assembly 134 is rotated (turned over) to the position depicted in FIG. 18 with the wedge-shaped finger ends 150 of fingers 138 facing forward. With index block 116 now turned over, one of the holes 148 in the index block 116 is placed over the pin 130 in platform 114. Hole 148 selection depends on the finger 138 projection desired since hole 148 position thereby controls the protrusion of the angled surface or wedge-shaped end 150 of the fingers 138 such that, with a specific diameter straight cutter used in a router with a guide bushing, such as the oval guidebush disclosed in U.S. Pat. No. 8,256,475 and U.S. patent application Ser. No. 13/566,345 filed Aug. 3, 2012 (Patent Publication no US 2012/029192, published Nov. 22, 2012) referenced above, and with the bush set at its median diameter, the cutter will form a through dovetail pin that is exactly the same width as the socket formed by the corresponding dovetail bit in the tail-mode described above. For instance, with the illustrated pin hole 48 positioned on the pin 130, a 7/16" wide pin will be cut and will match the socket cut by a 7/16" bit. Precise fit is achieved by adjusting the bushing.

Additional holes 152 and 154 (easily seen in FIG. 14) usable when the finger assembly is positioned in the through dovetail tail cutting mode or the through dovetail pin cutting mode allow the routing of the two smaller through dovetail joints at closer centers. For example, the 1¼" through dovetails can be centered at ⅝" and the 5/16" through dovetails can be centered at ¾".

Half Blind Dovetail Pins

Figure 7:
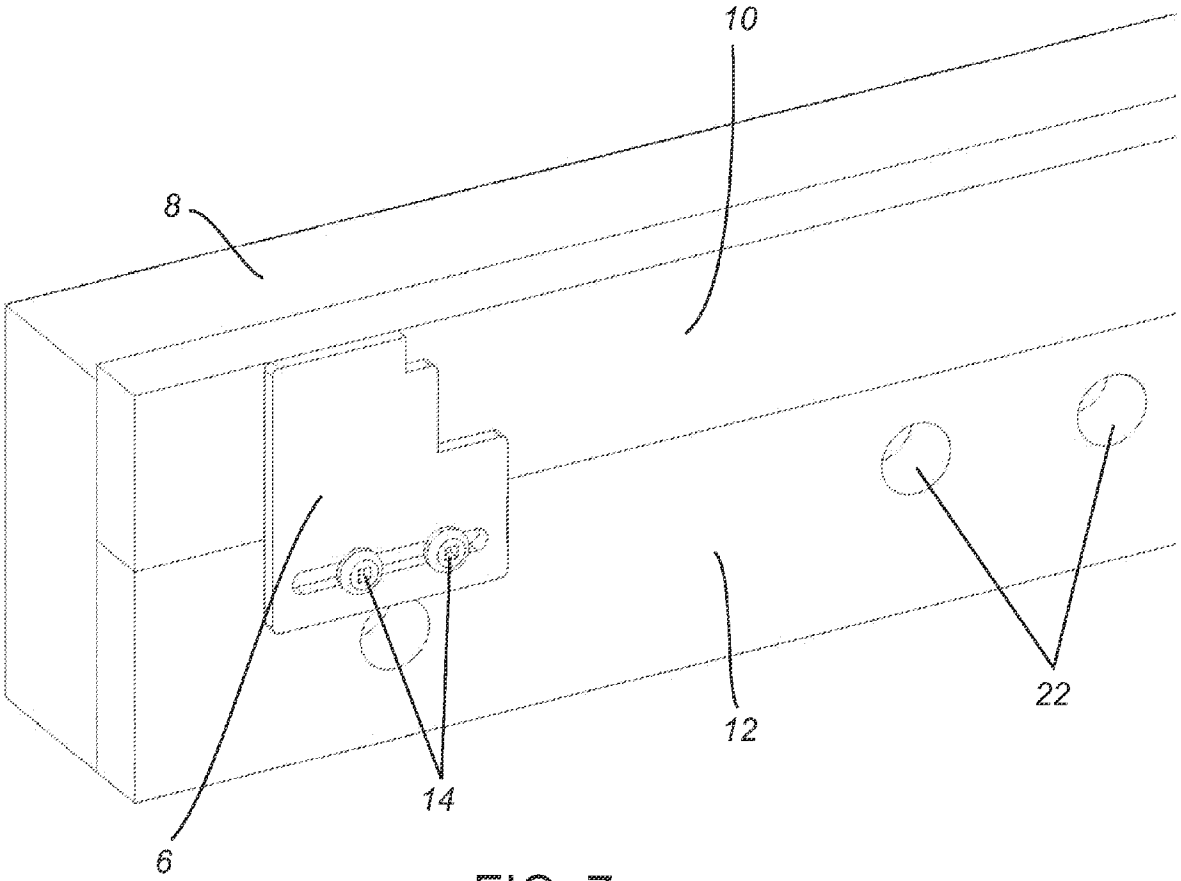
FIG. 7 is an enlarged isometric view of the side stop depicted in FIG. 1.
Figure 19:
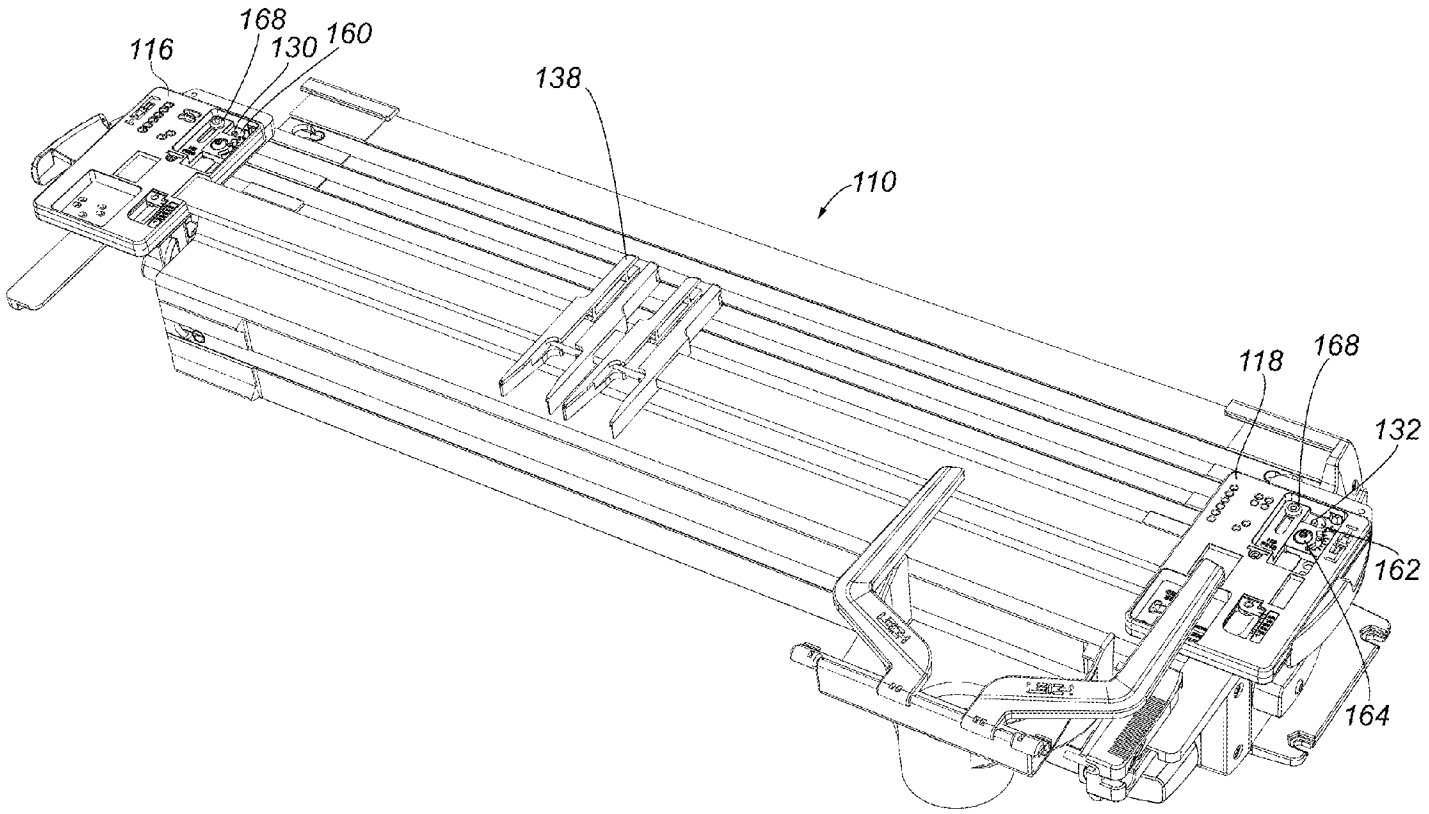
FIG. 19 is a perspective view of the top, front and right end of the joint making jig embodiment shown in FIG. 14 with an index finger assemble positioned for forming half-blind dovetail pins.

Flipping the finger assembly 134 end-for-end (as shown in FIGS. 14 and 19) makes it possible to cut half blind dovetail joint members. The half blind dovetail pin and tail holes are all in bar 160 in index block 116 positioned on the left side of the jig 110 in FIGS. 19 and 20 and in bar 162 in index block 118 that is on the 162 right side of the jig 10 in FIGS. 6 and 7. Bars 60 and 62 are secured in the index blocks 118 and 116 (and therefore in finger assembly 134) and are adjustable front to back of finger assembly 34 by tightening and loosening the appropriate one of the square drive screws 168 (or any other appropriate screw, bolt or other locking or securing device). The position of finger assembly 134 as far forward as possible is for routing shallow sockets in the end of a horizontally mounted pin board (not shown in the FIG. s) (e.g., a drawer front). An index 164 (see FIGS. 17, 21, 22 and 23) can be calibrated, for example, to indicate the appropriate locating for different board thicknesses from, for instance, ¼" to 1".

Half Blind Dovetail Tails

Figure 20:
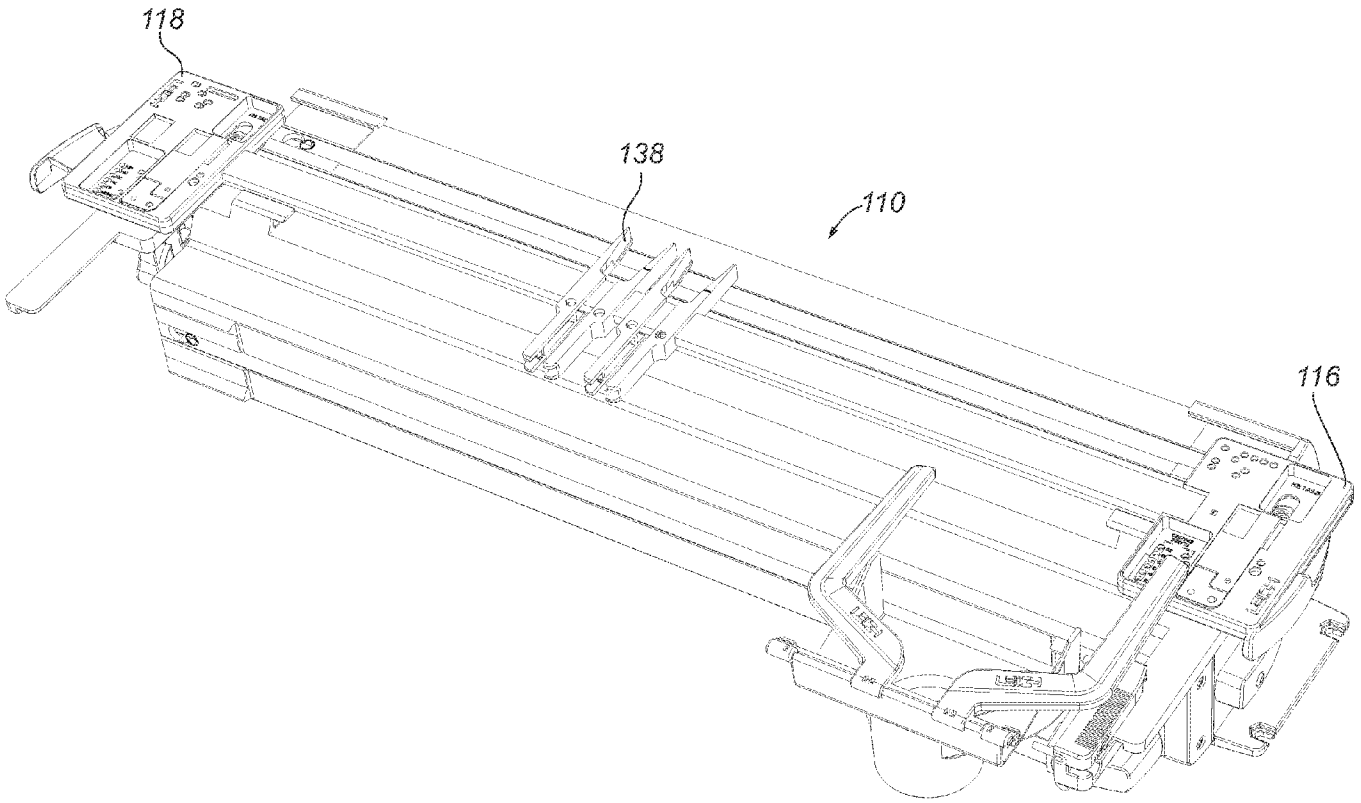
FIG. 20 is a perspective view of the top, front and right end of the joint making jig embodiment shown in FIG. 14 with an index finger assemble positioned for forming half-blind dovetail tails.
Figure 21:
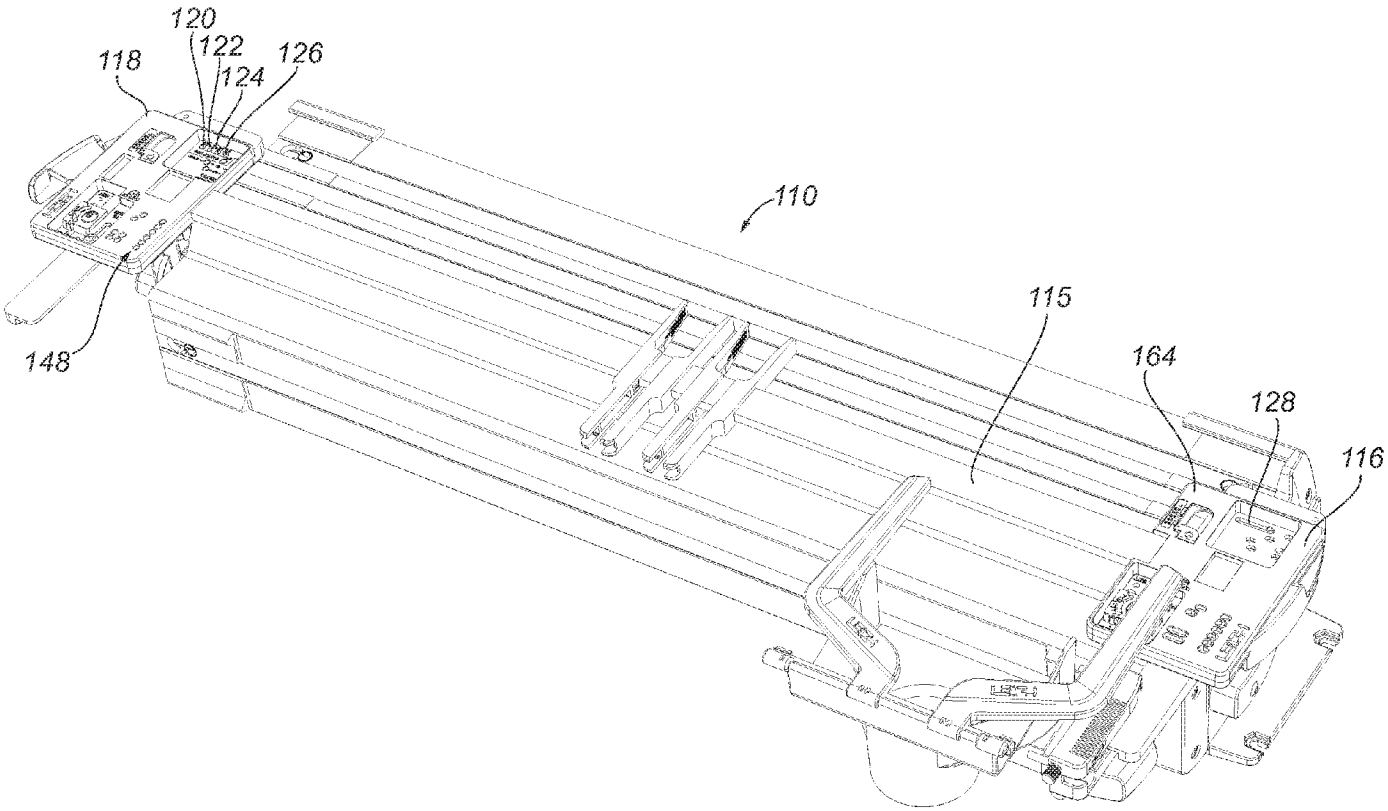
FIG. 21 is a perspective view of the top, front and right end of the joint making jig embodiment shown in FIG. 14 with an index finger assemble positioned for forming half-inch box joints.
Figure 22:
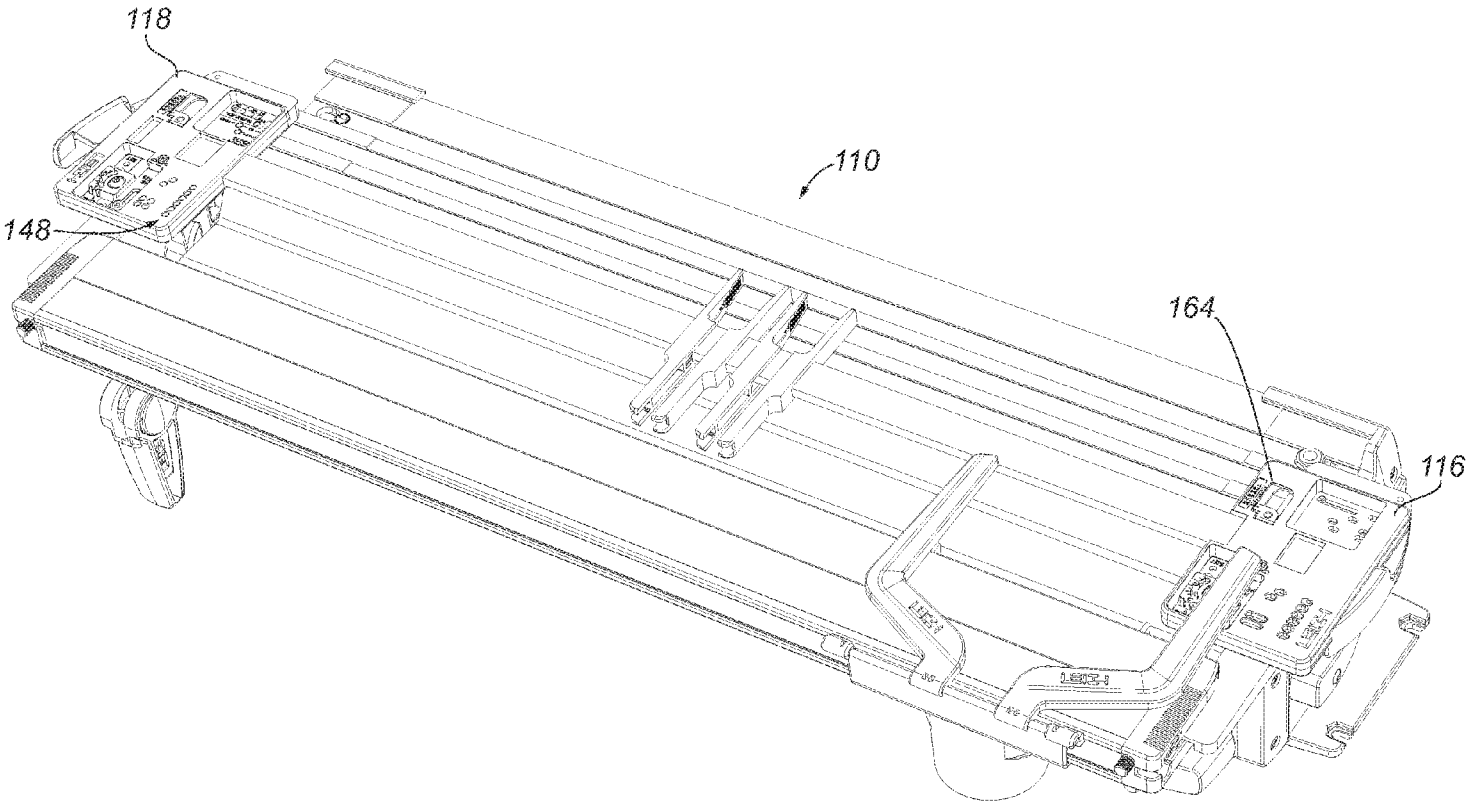
FIG. 22 is a perspective view of the top, front and right end of the joint making jig embodiment shown in FIG. 14 with an index finger assemble positioned for forming 1¼" box joints.

Rotating the finger assembly 134 to the position shown in FIG. 20 automatically positions fingers 138 to rout half blind dovetail tails, the thickness of which will match the horizontal depth of the sockets in the pin board.

Half Blind Dovetail Joint Fit

As with all half blind dovetail joint making jigs, joint fit is determined by adjusting the dovetail cutter depth. However, by using an adjustable bushing, the user can be provided with depth gages to preset the bit depth because further adjustment of joint fit can be accomplished using an adjustable bushing.

Figure 17:
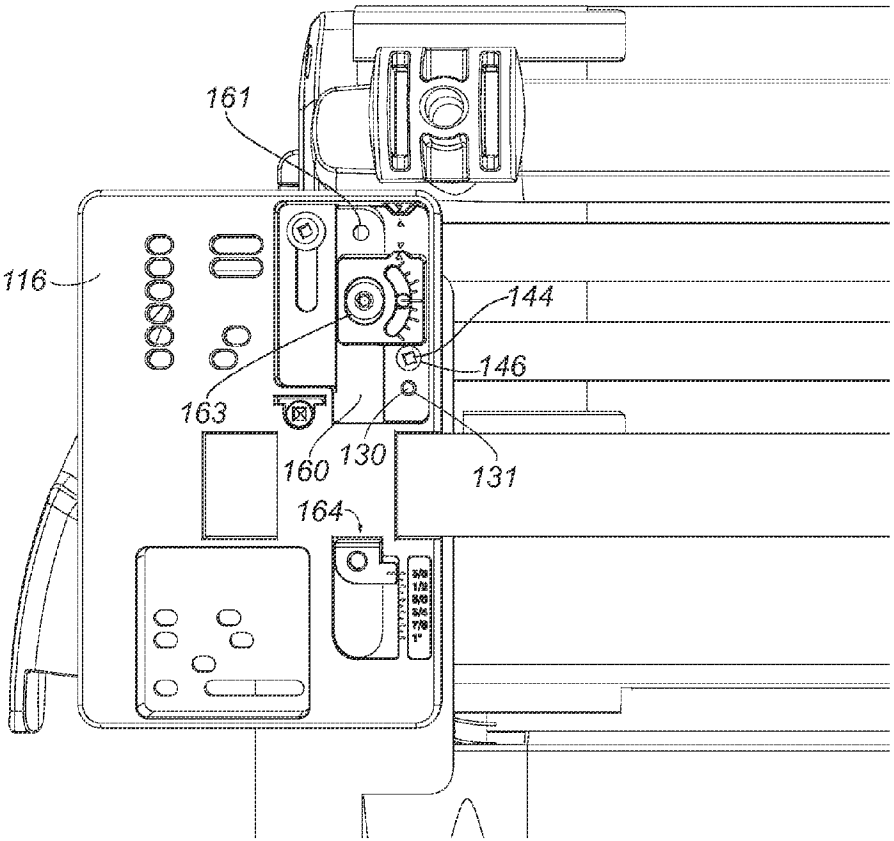
FIG. 17 is an enlarged segment of the configuration of FIG. 16 showing in plan the left hand end of the jig in set-up mode.

As best seen in FIGS. 17 and 23, flush relative position of half blind dovetail joint components is adjusted by adjustment of the position of bars 160 and 162 position, which moves pin holes 161 and 163 in those bars. Bar 162 position can be adjusted by, for instance, plus/minus 1.00 mm. Each bar 160 and 162 is secured by a screw 165; which can be a hex recess screw as depicted in the FIG. s or any other appropriate fastener.

Half Inch Box

The same configuration may be used for cutting through dovetail tales and half inch box joint components. Guide finger spacers may be used to precisely position and space the guide fingers 138 so that box joint components may be routed with appropriate bits. The first cut for half of the box joints will be made using the "through dovetail tails" hole 126 (in FIG. 21). The mating boards will then be machined using selected pin holes to the left such as holes 124, 122 or 120 corresponding to spacing, such as, for example the ½" as shown, or ¾", 1" and 1¼". (In the illustrated embodiment, one of the box joint offset holes, 127 that may be for ⅜" spacing is offset below hole 126 to avoid undesirably weakening the hole-containing member. All workpieces are set against the same jig side stop 170. Joint fit again may be controlled by use of an adjustable bushing.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

For instance, components carrying a pin in the illustrated embodiment could instead carry a hole for receiving a pin in a component in the illustrated embodiment that carries a hole.

Similarly, while the jigs 1 and 110 depicted in the drawings and described above are "bench-type" jigs that do not move and that hold workpieces immobile during joint-cutting operations, the principals and illustrative components above of this invention described above could be incorporated in movable jigs that move (together with the workpieces) relative to a fixed-position rotating cutter during joint-cutting operations.

The invention claimed is:

1. A woodcutting jig for cutting woodworking joints comprising:

(a) a template for guiding a path of a cutting tool, wherein the template has a length, a template first end, and a template second end;

(b) a base for holding a workpiece during use of the cutting tool, the base comprising a beam having a length that is at least twice as long as the length of the template, wherein the base has a base first end and a base second end; and (c) at least three positioning members secured to the base and equally spaced from each other along the length of the base, wherein each positioning member comprises an indexing pin extending from the base, wherein:

the template comprises (i) a plurality of holes adjacent to the template first end and arranged in a single row and (ii) at least one hole adjacent to the template second end and positioned in line with the row of holes adjacent to the template first end; and the template is removably securable to the base in: (1) a first position in which one of the plurality of holes adjacent to the template first end engages a first indexing pin of the positioning members and the at least one hole adjacent to the template second end engages a second indexing pin of the positioning members; and (2) a second position stepped over from the first position in which one of the plurality of holes adjacent to the template first end engages the second indexing pin of the positioning members and the at least one hole adjacent to the template second end engages a third indexing pin of the positioning members.

2. A woodcutting jig for cutting woodworking joints comprising:

(a) a template for guiding a path of a cutting tool, wherein the template comprises a plate with a length, a template first end, a template second end, a first template engaging member located adjacent to the template first end, a second template engaging member located adjacent to the template second end, and a planar surface for supporting a cutting tool reference surface;

(b) a base for holding a workpiece during use of the jig for cutting woodworking joints, the base comprising a beam that is longer than the length of the template, wherein the base has a base first end and a base second ends; and (c) at least three positioning members comprising a first positioning member disposed adjacent to the base first end, a second positioning member disposed adjacent to the base second end, and a third positioning member disposed halfway between the first and second positioning members, wherein the at least three positioning members are secured to the base and wherein each positioning member comprises a base engaging member, wherein:

the template is constrained in position relative to the base except that the template can move away from the base in a direction perpendicular to the planar surface of the template; and the template is removably securable to the base in: (i) a first position in which the first template engaging member engages the first positioning member and the second template engaging member engages the third positioning member and (ii) a second position stepped over from the first position in which the first template engaging member engages the third positioning member and the second template engaging member engages the second positioning member.

3. The jig of claim 2, wherein each base engaging member comprises an indexing pin, the first template engaging member comprises a plurality of holes, and the second template engaging member comprises a slot and wherein:

in the first position, one of the plurality of holes engages the indexing pin of the first positioning member and the slot engages the indexing pin of the third positioning member; and in the second position, one of the plurality of holes engages the indexing pin of the third positioning member and the slot engages the indexing pin of the second positioning member.

4. The jig of claim 2, wherein the first template engaging member comprises a first plurality of holes arranged in a single row along a line parallel to the length of the plate and the second template engaging member comprises a second plurality of holes arranged in a single row along the line.

5. The jig of claim 2, wherein the first template engaging member comprises a first plurality of holes arranged in a single row along a line parallel to the length of the plate and the second template engaging member comprises a slot that extends along the line.

6. The jig of claim 2, wherein each of the at least three positioning members comprises a pin plate attached to the base with at least two fasteners, the pin plate comprising an indexing pin.

7. The jig of claim 2, wherein the at least three positioning members further comprise a fourth positioning member wherein the third and fourth positioning members are disposed between the base first and second ends.

8. The jig of claim 7, wherein the template is removably securable to the base in:

(i) a first position in which the first template engaging member engages the first positioning member and the second template engaging member engages the third positioning member;

(ii) a second position in which the first template engaging member engages the third positioning member and the second template engaging member engages the fourth positioning member; and (iii) a third position in which the first template engaging member engages the fourth positioning member and the second template engaging member engages the second positioning member.

9. The jig of claim 2, further comprising a lock for securing the template to each of the at least three positioning members during use of the jig for cutting woodworking joints.

10. An apparatus for guiding the cutting of joint members in wood workpieces using a woodworking power tool, the apparatus comprising:

(a) a template comprising at least one planar surface, a plurality of dovetail pin guide fingers arranged along a first side of the template and extending outwardly from the template, and a plurality of dovetail tail guide fingers arranged along a second side of the template, wherein the dovetail pin guide fingers include guide surfaces that are orthogonal to the at least one planar surface, wherein the dovetail pin guide fingers taper as they extend outwardly from the template, wherein guide portions of the dovetail tail guide fingers are non-tapered;

(b) a body, wherein the template and body are configured to secure to one another in a plurality of fixed, pre-determined positions, wherein the body is configured to facilitate securing a wood workpiece to a face of the body such that, when the template is secured to the body in at least one of the plurality of fixed, pre-determined positions and when the wood workpiece is secured to the body, at least portions of at least some of the dovetail pin guide fingers are positioned over an end of the wood workpiece; and (c) at least two indexing pins extending from the body and at least two sets of Y-axis openings extending through the template, wherein the Y-axis openings are configured to receive the at least two indexing pins, wherein the at least two indexing pins and the Y-axis openings are positioned and configured to establish at least some of the plurality of fixed, pre-determined positions such that at least some of the plurality of fixed, pre-determined positions correspond to a plurality of pre-determined dovetail pin sizes, wherein the template further comprises at least one set of additional openings extending through the template and configured to receive at least one of the at least two indexing pins, wherein the at least one set of additional openings are arranged along an axis that is substantially perpendicular to an axis along which the Y-axis openings are arranged.

11. The apparatus of claim 10, wherein the at least one set of additional openings comprises a first set of holes proximate one end of the template and an elongated slot proximate another end of the template.

12. The apparatus of claim 10, wherein the at least two indexing pins are attached to the body in an adjustable manner.

13. The apparatus of claim 12, wherein the template includes apertures extending through the template that are positioned and configured to facilitate adjustment of the indexing pins relative to the body while the template is secured to the body.

14. The apparatus of claim 10, wherein the at least two indexing pins and Y-axis openings are positioned and configured such that, when the template is secured to the body in at least one of the plurality of fixed, pre-determined positions and the wood workpiece is secured to the body, the at least one of the plurality of fixed, pre-determined positions of the template relative to the body results in wider portions of the dovetail pin guide fingers overlying the end of the wood workpiece than when in other of the plurality of fixed, pre-determined positions.

15. A woodcutting jig for cutting woodworking joints comprising:

(a) a jig body to which workpieces may be attached, the body having two ends, (b) a template assembly comprising:

(i) a template bar having two ends, (ii) attached to one end of the template bar, a first index block having at least two pin-receiving holes, (iii) attached to the other end of the template bar, a second index block having at least one pin-receiving slot, and (iv) guide fingers repositionably attachable to the template bar for guiding a path of a cutting tool during formation of woodworking joint components, and (c) for positioning the template assembly on the jig body, a first pin attached near one end of the body for receipt in a selected one of the at least two holes and a second pin attached near the other end of the body for receipt in the at least one pin-receiving slot.

16. The jig of claim 15, wherein a position of at least one of the first pin and the second pin is adjustable.

17. A method of forming a woodworking joint for joining two workpieces, the method comprising:

(a) securing a first workpiece to a joint making jig, the jig comprising:

(i) a base to which the workpieces are secured, (ii) a template for guiding a router, wherein the template comprises (a) a plurality of holes arranged in a single row along a first axis and located adjacent to a first end and (b) a slot extending located adjacent to a second end and positioned along the first axis, (iii) at least two pin plates that are secured to the base, wherein each pin plate comprises a fixed indexing pin, (b) securing the template to the base such that one of the plurality of holes adjacent to the first end engages the fixed indexing pin of a first pin plate and the slot adjacent to the second end engages the fixed indexing pin of a second positioning member, (c) using the router guided by the template to cut joint members in the first workpiece, (d) removing the first workpiece and securing a second workpiece to the base, (e) securing the template to the base such that the fixed indexing pin of the first positioning member engages one of a first array of holes and the fixed indexing pin of the second positioning member engages one of a second array of holes, wherein the first and second arrays of holes each comprise a plurality of holes arranged in a single row along a second axis that is perpendicular to the first axis, and (f) using the router guided by the template to cut joint members in the second workpiece.

* * * * *